US010308460B2

(12) United States Patent
Hitsman et al.

(10) Patent No.: US 10,308,460 B2
(45) Date of Patent: Jun. 4, 2019

(54) WEB TRANSFER DEVICE WITH VACUUM HOOD AND METHODS FOR WEB TRANSFER

(71) Applicant: Davis-Standard, LLC, Pawcatuck, CT (US)

(72) Inventors: Michael Hitsman, Fulton, NY (US); Brian Ouderkirk, Fulton, NY (US); Lawrence Fraser, Fulton, NY (US)

(73) Assignee: Davis-Standard, LLC, Pawcatuck, CT (US)

( * ) Notice: Subject to any disclaimer, the term of this patent is extended or adjusted under 35 U.S.C. 154(b) by 445 days.

(21) Appl. No.: 15/059,851

(22) Filed: Mar. 3, 2016

(65) Prior Publication Data

US 2016/0257519 A1 Sep. 8, 2016

Related U.S. Application Data

(60) Provisional application No. 62/127,573, filed on Mar. 3, 2015.

(51) Int. Cl.
*B65H 19/22* (2006.01)
*B65H 19/28* (2006.01)

(52) U.S. Cl.
CPC ..... *B65H 19/28* (2013.01); *B65H 19/2215* (2013.01); *B65H 2406/35* (2013.01)

(58) Field of Classification Search
CPC . B65H 19/28; B65H 19/2215; B65H 2406/35
See application file for complete search history.

(56) References Cited

U.S. PATENT DOCUMENTS 3,861,259 A * 1/1975 Hitch ..... B65H 29/242 271/197
4,529,141 A * 7/1985 McClenathan ..... B26D 1/425 242/527.1
5,337,968 A * 8/1994 De Bin ..... B65H 19/2223 242/521
6,051,095 A * 4/2000 Butterworth ..... B65H 19/1836 156/157
2010/0294876 A1* 11/2010 Smith ..... B65H 19/2238 242/523.1

* cited by examiner

*Primary Examiner* — William A. Rivera
(74) *Attorney, Agent, or Firm* — Murtha Cullina LLP

(57) ABSTRACT

A web transfer device for a multiple turret winder on a continuous web process line includes a web delivery assembly having delivery rolls and a core transfer assembly having one or more core receiving structures. The transfer device includes a web transfer assembly configured to receive a web from the web delivery assembly and configured to communicate with the core transfer assembly. The web transfer assembly includes a frame and lay-on roll moveably positioned relative to the frame. The web transfer assembly includes a vacuum hood moveably positioned relative to the frame. The vacuum hood has a cutting device mounted therein and one or more suction holding surfaces that are configured to releasably hold a portion of the web. The suction holding surfaces are movable relative to the frame and the core receiving structures. The suction holding surfaces communicate with the core receiving structures to transfer the web thereto.

10 Claims, 27 Drawing Sheets

WEB TRANSFER DEVICE WITH VACUUM HOOD AND METHODS FOR WEB TRANSFER

CROSS REFERENCE TO RELATED APPLICATIONS

This application claims priority to U.S. Provisional Patent Application Ser. No. 62/127,573, entitled "Web Splicing Device with Vacuum Hood," and filed Mar. 3, 2015, the subject matter of which is incorporated herein by reference in its entirety.

FIELD OF THE INVENTION

The present invention relates generally to a web transfer device for a multiple spindle turret type winder for use in a continuous web process line and more particularly to a web transfer device having a transfer apparatus that employs a vacuum hood assembly for holding, cutting and transferring the web from a full core to a new core. The present invention is also directed to methods for web transfer in a continuous web process line.

BACKGROUND OF THE INVENTION

Turret winders wind webs of paper, paperboard and non-paper products, such as film and polyethylene, onto cores and into rolls. Products, properties, speeds and widths vary from winder to winder and from plant to plant. The proper procedure of threading and attaching each particular product to the winder, therefore, varies as well from winder to winder.

In addition, many turret winders wind rolls of paper or film using a pressure roll, sometimes called a rider roll, pack roll, lay-on roll, or bump roll. Typically, the lay-on roll is a straight beam (e.g., cylindrical shaft, spindle or tube) which applies pressure to the film as it is being wound onto one or more cores into one or more winding rolls positioned on a core shaft of the turret winder. When one of the cores has a full capacity of the web wound thereon (i.e., full core), the web is typically cut thereby creating a trailing edge and a new leading edge of the web. The trailing edge is wound around the full core and the full core is move to an outboard position on the turret. The turret positions a new core into position for receiving the new leading edge. The transfer of the web from the full core to the new core occurs during production in a continuous mode. Prior art cutting devices are known to leave non-uniform leading edges and trailing edges. This can create non-uniform web build up on the new core and can lead to waste associated with removing a portion of the web proximate the tail on the full core. Such waste is of particular concern for self-wound-adhesive webs, expensive web materials and automated packaging applications.

There is a need to improve the process for cutting and transferring the web from a full core to a new core.

SUMMARY

There is disclosed herein a web transfer device for a multiple turret winder on a continuous web process line. The web transfer device includes a web delivery assembly having delivery rolls and a core transfer assembly having one or more core receiving structures. The transfer device includes a web transfer assembly configured to receive a web from the web delivery assembly and configured to communicate with the core transfer assembly. The web transfer assembly includes a frame and lay-on roll moveably positioned relative to the frame. The web transfer assembly includes a vacuum hood moveably positioned relative to the frame. The vacuum hood has a cutting device mounted therein and one or more suction holding surfaces that are configured to releasably hold a portion of the web. The suction holding surfaces are movable relative to the frame and the core receiving structures. The suction holding surfaces communicate with the core receiving structures to transfer the web thereto.

There is further disclosed herein a method for transferring a web in a continuous web process line. The method includes providing a web transfer device that includes a web delivery assembly comprising one or more web delivery roll, a core transfer assembly comprising two ore more core receiving structures; and a web transfer assembly configured to receive a web from the web delivery assembly and configured to communicate with the core transfer assembly. The method includes providing the web transfer assembly with a frame and lay-on roll moveably positioned relative to the frame. The web transfer assembly includes a vacuum hood moveably positioned relative to the frame. The vacuum hood has a cutting device mounted therein. The vacuum hood has one or more suction holding surfaces. The method includes the following steps in this order: a) stopping the web on one of the at least two core receiving structures; b) holding the web with the at least one suction holding surface; c) cutting the web with the cutting device to create a leading edge and a trailing edge; d) releasing the trailing edge from the at least one suction holding surface; and e) securing the leading edge, via the at least one suction holding surface, to another of the least two core receiving structures.

DETAILED DESCRIPTION OF THE INVENTION

Figure 1A:
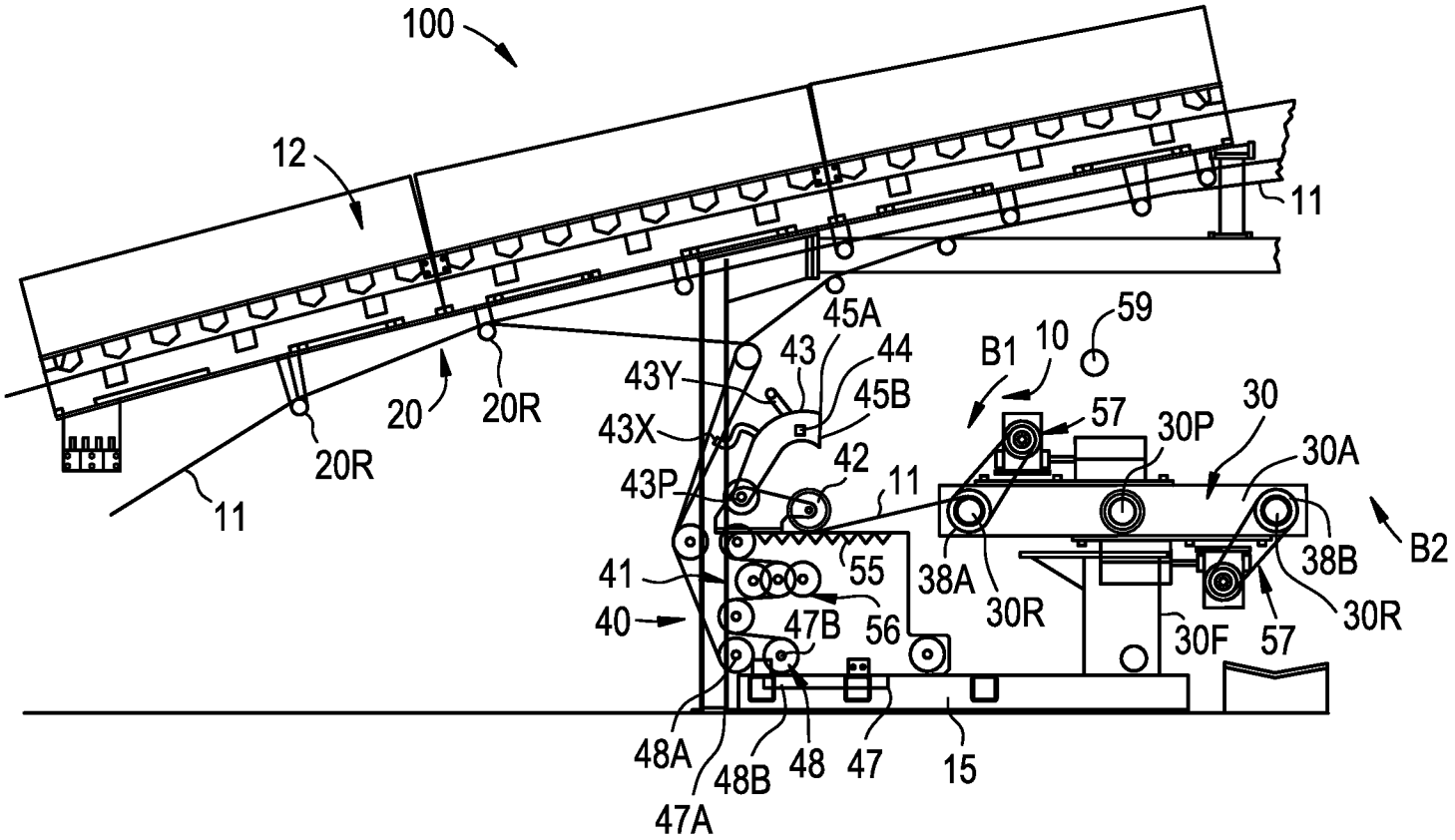
FIG. 1A is a schematic view of a portion of a continuous web processor line showing a web transfer device of the present invention in an initial thread up configuration.
Figure 1B:
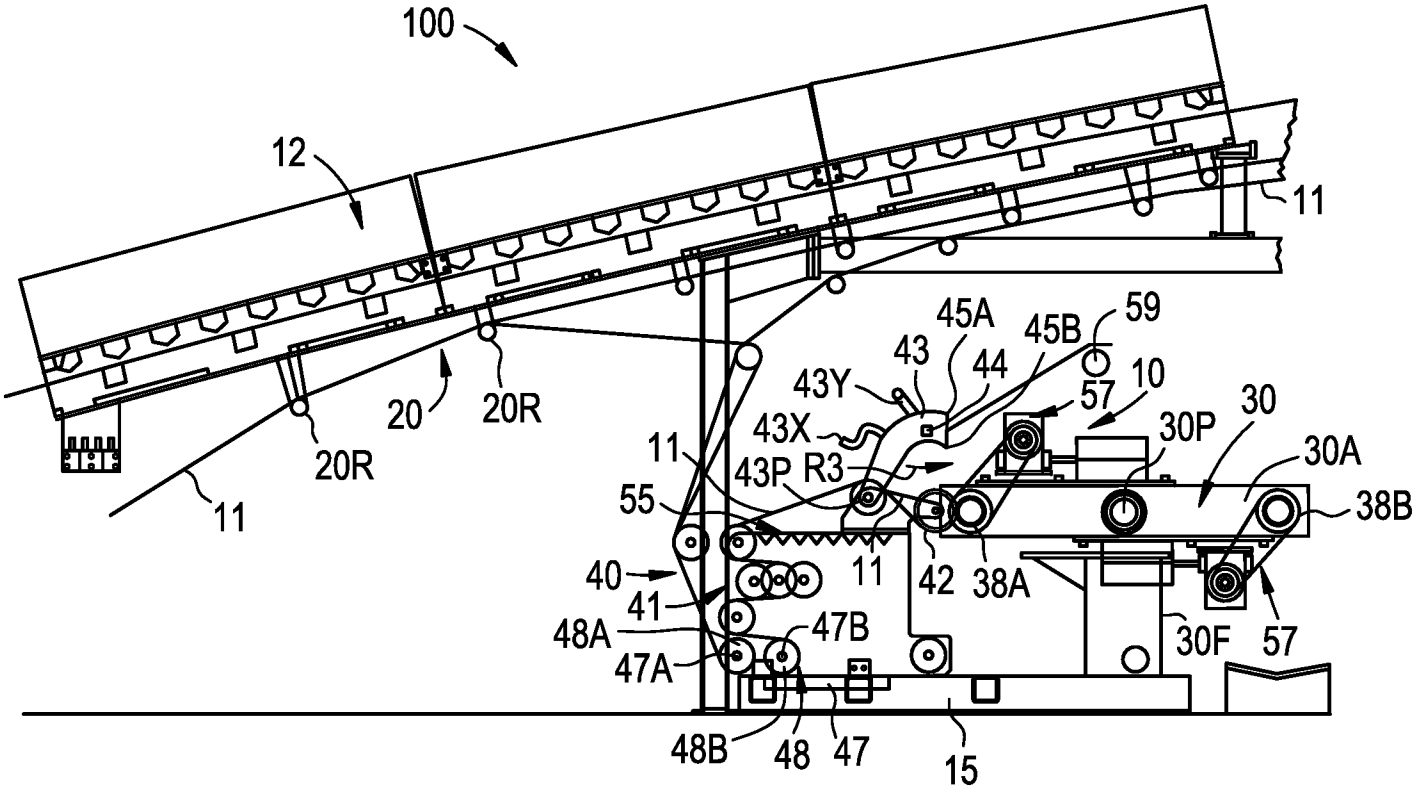
FIG. 1B is a schematic view of the portion of the continuous web processor line showing the transfer device in a winding configuration on a new core.
Figure 1C:
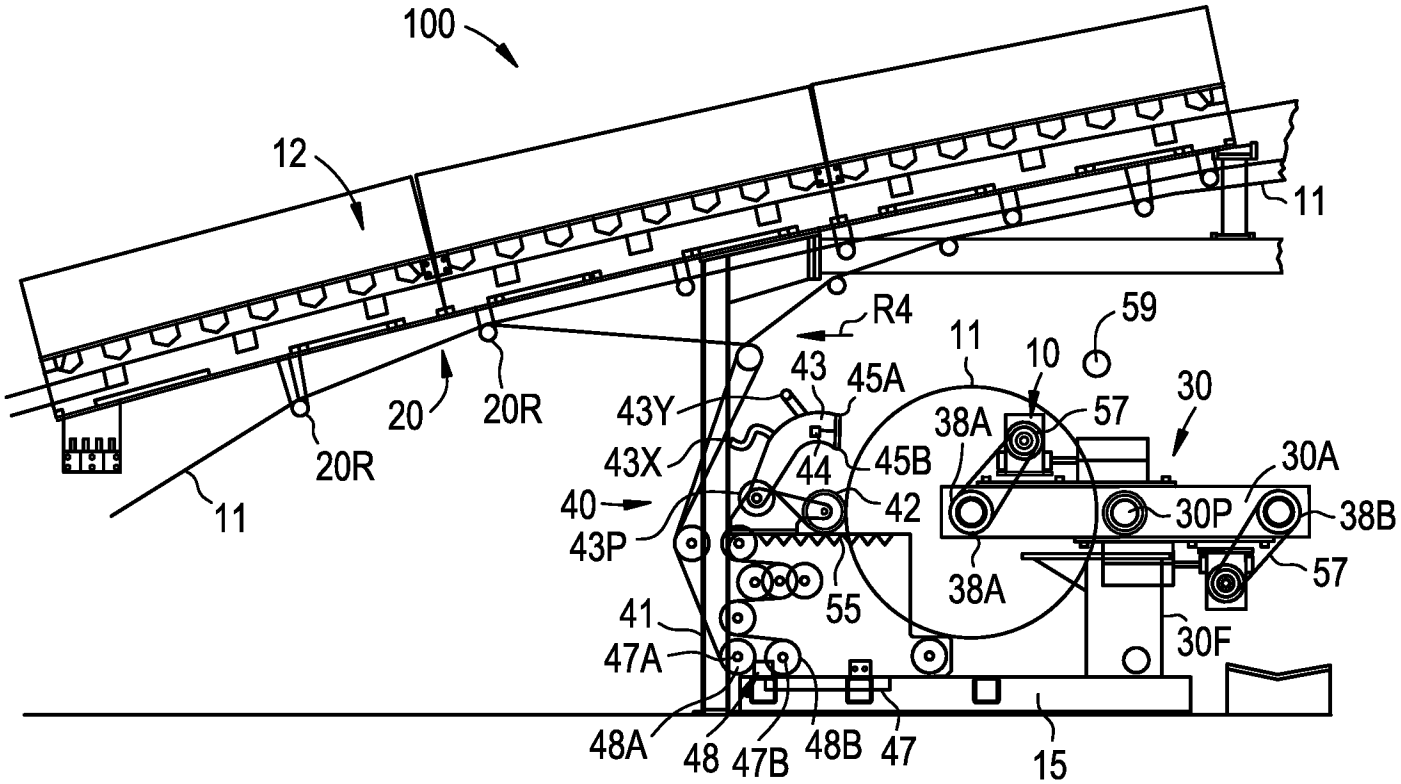
FIG. 1C is a schematic view of the portion of the continuous web processor line showing the transfer device in the winding configuration on a full core.
Figure 1D:
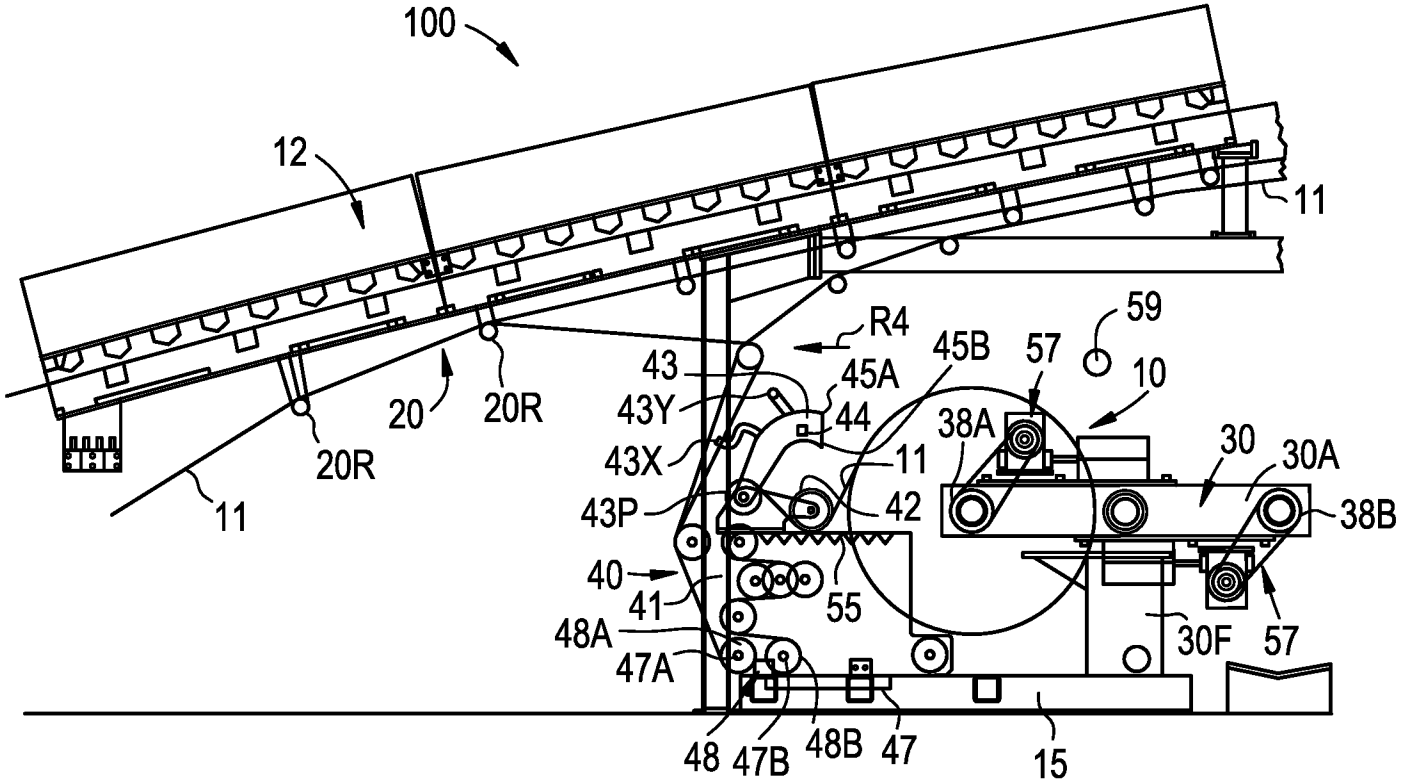
FIG. 1D is a schematic view of the portion of the continuous web processor line showing the transfer device in a configuration ready of turret indexing.
Figure 1E:
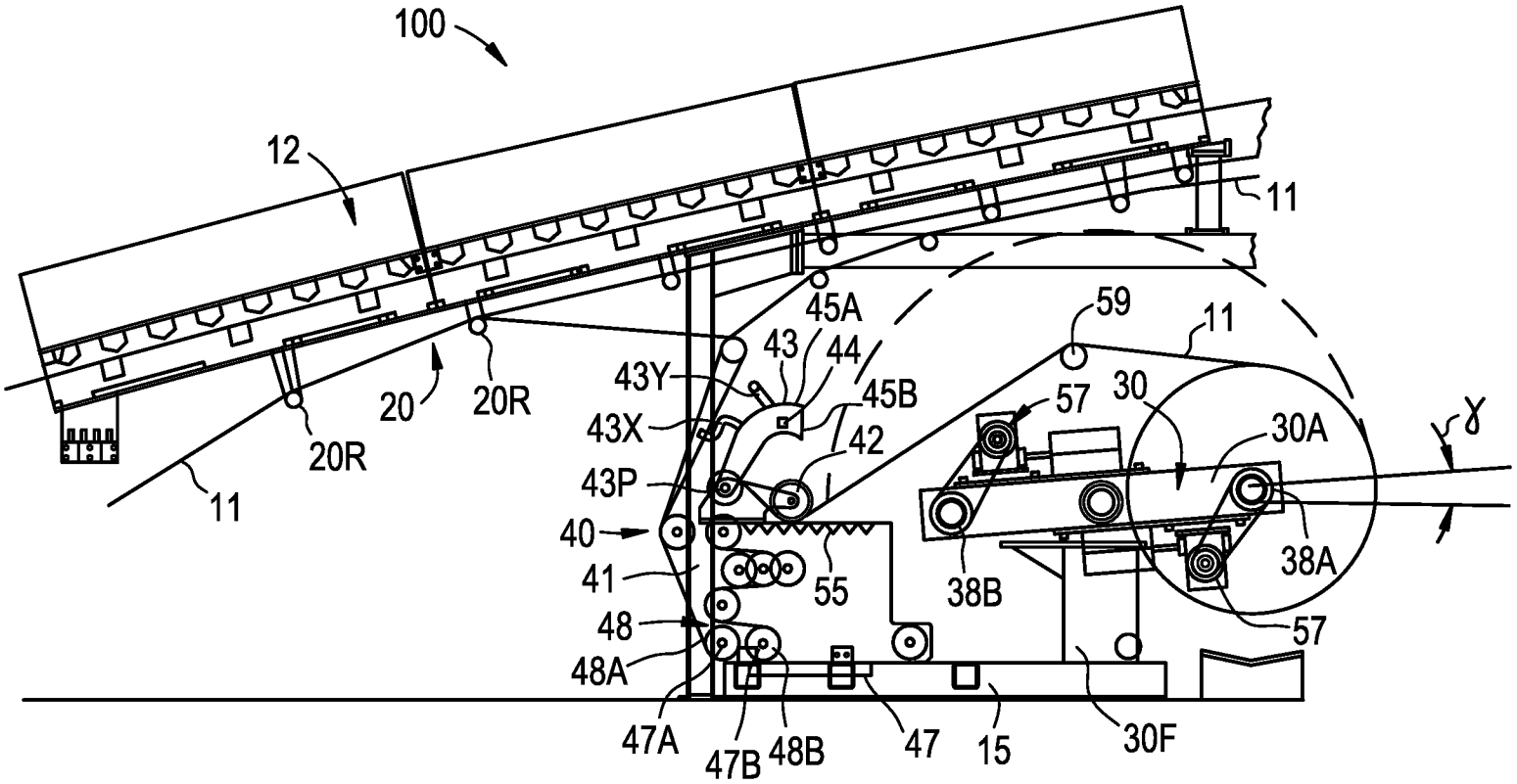
FIG. 1E is a schematic view of the portion of the continuous web processor line showing the turret having indexed to a roll-change position.
Figure 5:
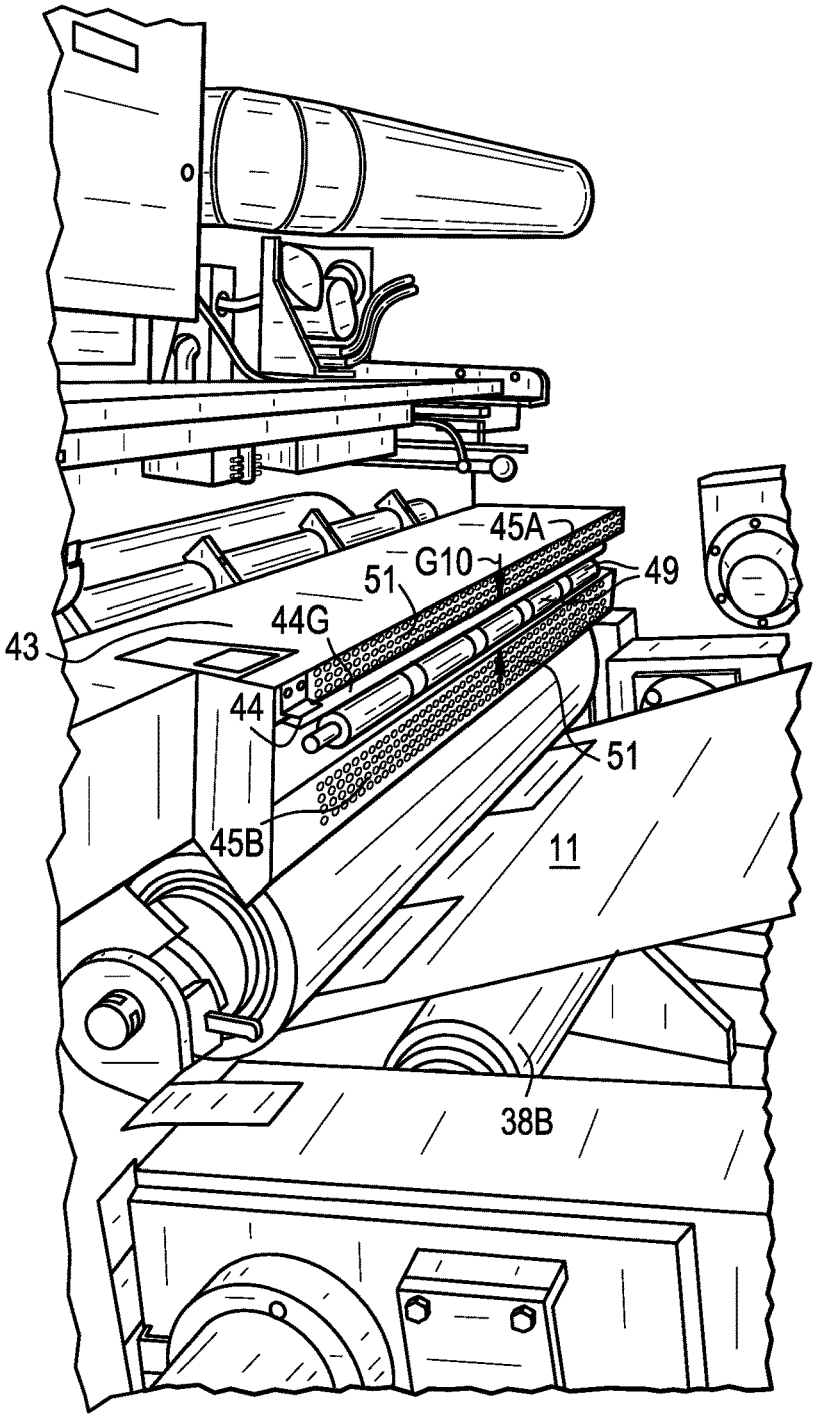
FIG. 5 is a photograph of the web transfer device of the continuous web processing line of FIG. 4 showing the cutter device in a standby position.

In reference to FIGS. 1A and 5, a web transfer device 10 for multiple turret winder 30 for a continuous web process line 100 includes a web delivery assembly 20 comprising at least one web delivery roll 20R. For example, the web delivery assembly 20 includes a web forming system that feeds a web 11 into a dryer assembly 12. The web transfer device 10 is particularly well suited for processing and splicing webs 11 made from Polyethylene and Polyurethane foams, with single sided or double sided pressure sensitive adhesive applied. The web 11 thickness can vary from 0.5 to 0.012 inches. The dryer assembly 12 includes a plurality of rollers 12R that support the web 11. The web transfer device 10 includes a core transfer assembly 30 that includes two core receiving structures 30R, for example a spindle 30R mounted on opposing ends of an arm 30A of a core transfer assembly, for example a turret 30. Each of the spindles 30R are adapted to receive a core 38A or 38B thereon for winding the web 11 there around. The arm 30A is pivotally mounted about a pivot (e.g., bearings) on a frame 30F (e.g., a two legged frame) that is fixedly secured to a foundation or base plate 15. Each of the spindles 30R are in communication with a drive mechanism 57 (e.g., motor, gear and or belt drive) to rotate the respective core 38A or 38B mounted thereon for causing the web 11 to be wound around the respective core 38A or 38B. The web 11 is wound around the respective core 38A or 38B until it reaches a maximum capacity. The turret 30 is configured to swing the arm 30A about the pivot point 30P to position a new core 38B for winding the web 11 there around while swinging the core 38A that is wound to full capacity with the web 11 in an unloading position for removal from the spindle 30R. Since the web 11 is continuously processed in the line 100, the web 11 is cut and positioned on the new core 38B as described further herein.

While the turret 30 is shown and described as having two core receiving structures 30R on opposing ends of the turret arm 30A, the present invention is not limited in this regard as the turret 30 may employ more than two core receiving structures 30R (e.g., three spindles).

The web transfer device 10 includes a web transfer assembly 40 configured to receive a web 11 from the web delivery assembly 20. The web transfer assembly 40 is configured to communicate with the core transfer assembly (e.g., a turret) 30. The web transfer assembly 40 includes a frame 41 and lay-on roll 42 moveably positioned relative to the frame 41. The frame 41 is fixedly secured to the base plate 15. The web transfer assembly 40 includes a vacuum hood 43 moveably positioned relative to the frame 41, for example via a pivot 43P. The vacuum hood 43 has a cutting device 44 moveably (e.g., axially slidably mounted for slitting or radially translationally mounted for chopping) mounted in a slot 44G in the suction holding surface 45A as described herein. The vacuum hood assembly 43 has two suction holding surfaces 45A, 45B. Vacuum sources 43X and 43Y are in communication with the suction holding surfaces 45A, 45B, respectively. The suction holding surfaces 45A, 45B are configured to releasably hold a portion of the web 11. The suction holding surfaces 45A, 45B are movable relative to the frame 41 and are moveable relative to the core receiving structure 30R and the cores 38A or 38B mounted thereon. For example, suction holding surfaces 45A, 45B move with the vacuum hood assembly 43 on a carriage assembly 55 such as a ball screw assembly that enables the vacuum hood assembly 43 to move translationally along the frame 41. Thus, the vacuum assembly 43 is moveable relative to the frame 41 and is moveable relative to the core receiving structure 30R and the cores 38A or 38B thereon. The lay-on roll 42 is also mounted to the carriage assembly 55 and is moveable relative to the frame 41 and is moveable relative to the core receiving structure 30R and the cores 38A or 38B thereon. The vacuum hood assembly 43 is pivotally mounted to the carriage assembly 55.

Figure 1F:
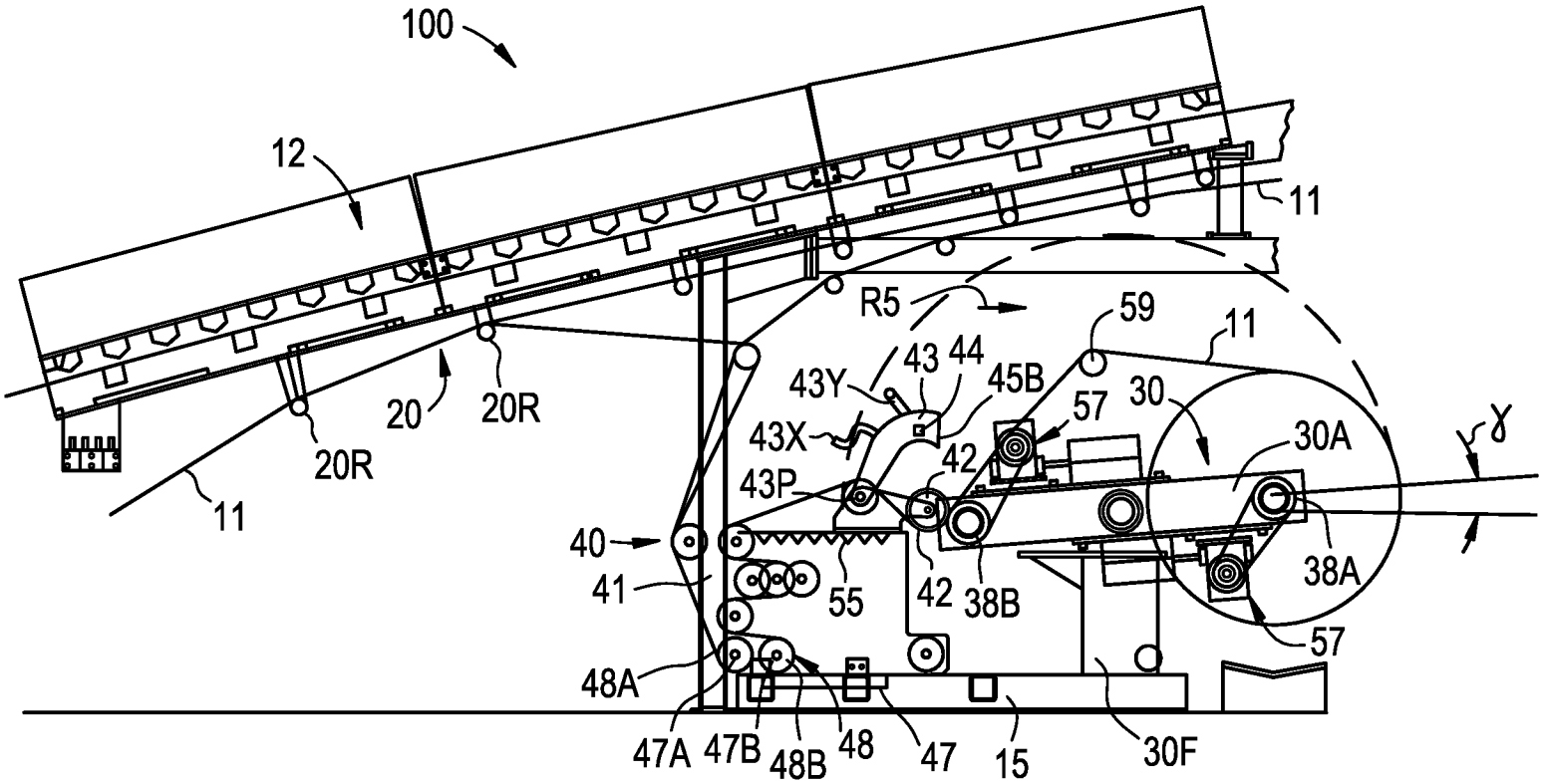
FIG. 1F is a schematic view of the portion of the continuous web processor line showing the transfer device in an initial position for web transfer with the turret indexed to the roll-change position.
Figure 1G:
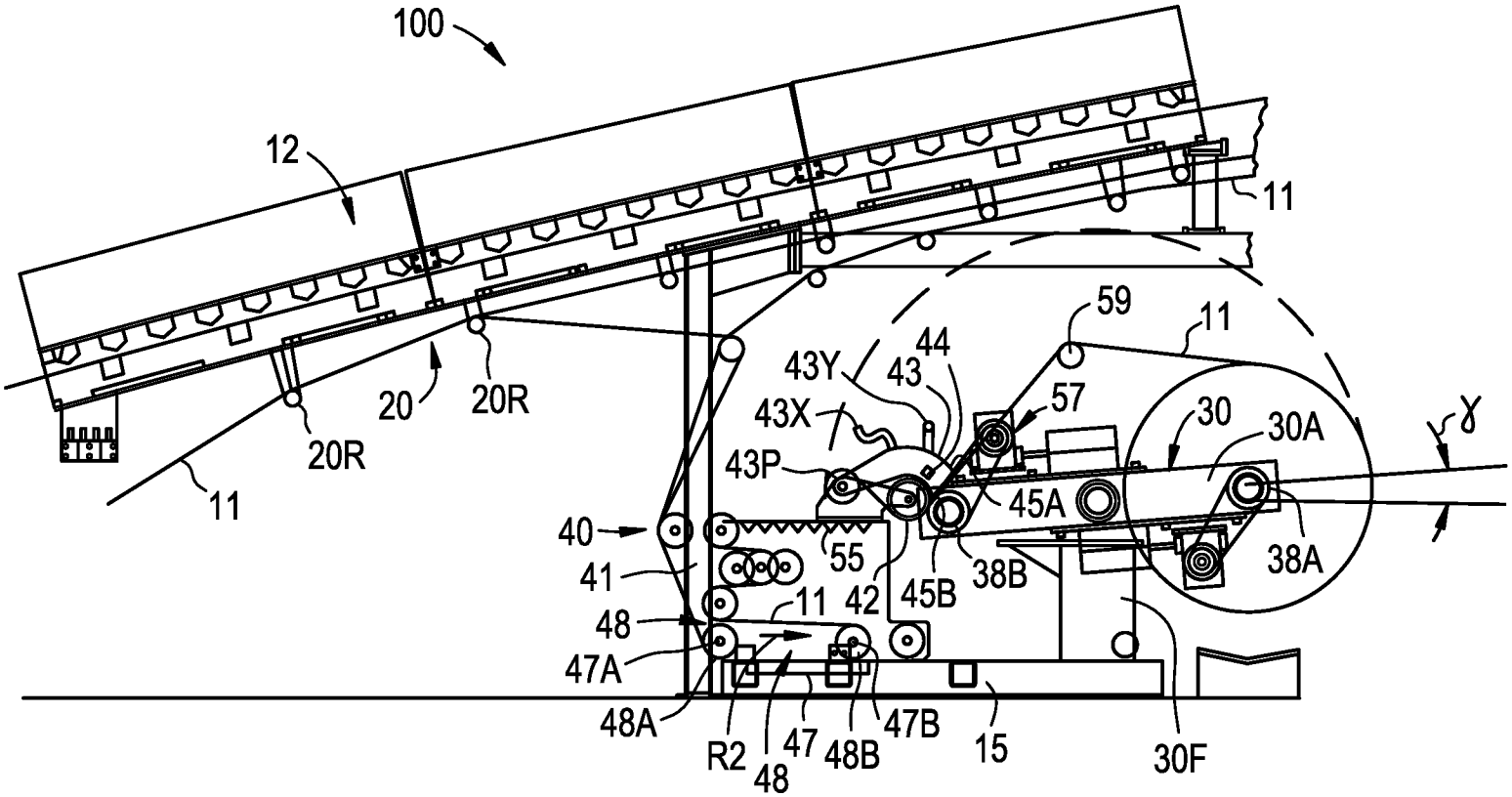
FIG. 1G is a schematic view of the portion of the continuous web processor line showing the web clamped against a portion of a vacuum hood of the transfer device for severing the web with the turret indexed to the roll-change position.
Figure 1H:
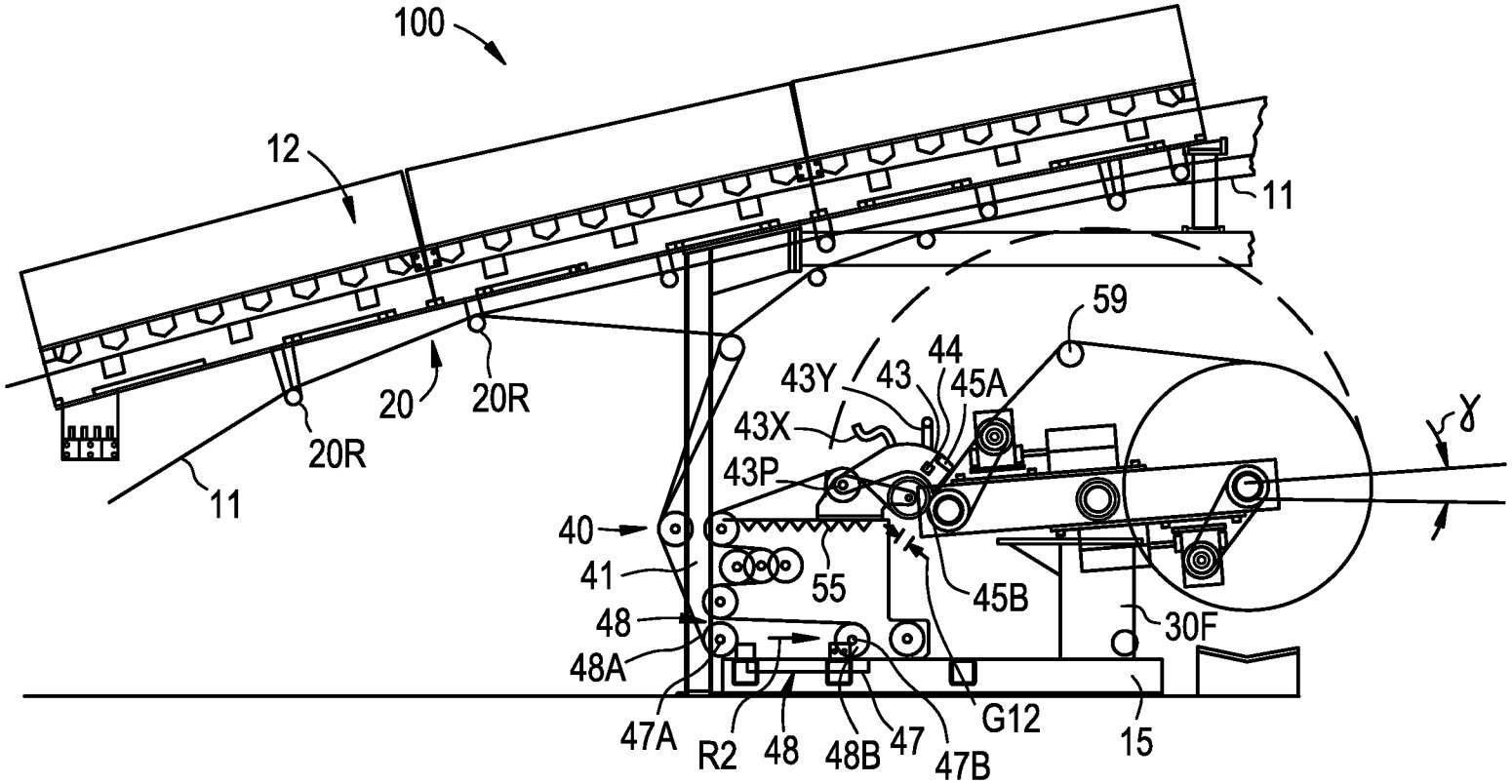
FIG. 1H is a schematic view of the portion of the continuous web processor line showing the severed web clamped against a portion of a vacuum hood with the transfer device slightly retracted and with the turret indexed to the roll-change position.

As shown in FIGS. 1A-1J the web transfer assembly 40 includes a horizontal traveling roller assembly 56 for spindle drive trim. As best shown in FIG. 1F the web transfer assembly 40 includes a carry-over idler roller 59 to guide the web 11 during the web transfer process.

The suction holding surfaces 45A, 45B communicate with the core receiving structure 30R to transfer the web 11 to a core 38A or 38B mounted on the spindle of the core receiving structure 30R. In the embodiments shown in FIGS. 1E-1J and 5-15 the web is cut after the full core 38A is moved to the outboard position (B2) and the new core 38A is in the inboard (B1) position and after cutting the web 11 the new leading edge 11L (see FIG. 14) is secured to a new empty core 38B. As used herein the term inboard position B1 refers to the spindle or core receiving assembly 30R being proximate the lay-on roll 42; and the outboard position B2 refers to the position of the core receiving structure 30R on an opposite end of the arm 30A of the turret 30.

In the embodiment shown in FIGS. 2A-2H and 3, the web 11 is cut while full core 38B is in the inboard position B1. After cutting the web 11, the full core 38B is placed in the outboard position B2 and a new core 38B is placed in the inboard position B1. The new leading edge 11L is secured to the new empty core 38B while in the inboard position B1.

The vacuum hood assembly 43 includes a pivot assembly 43P for pivotally mounting the vacuum hood assembly 43 to the carriage assembly 55. The vacuum hood assembly 43 is divided into two internal chambers (e.g., a first chamber and a second chamber). The first chamber has a first inlet defined by suction holding surface 45A and is in communication with a first vacuum supply 43X. The suction holding surface 45A has a plurality of holes 51 extending therethrough (see FIG. 5). The second chamber has a second inlet defined by the suction holding surface 45B and is in communication with a second vacuum supply 43Y. The suction holding surface 45B has a plurality of holes 51 extending therethrough (see FIG. 5). As shown in FIG. 5, the first inlet and the second inlet are spaced apart from one another defining a gap G10 therebetween. A plurality of rollers 49 is positioned in the gap G10. The suction holding surfaces 45A, 45B are coated with a lubricious material. In one embodiment, the lubricious material is PTFE.

As shown in FIG. 1A, the web transfer assembly 40 includes an accumulator 48 which has a first roller (e.g., an idler roller) 48A and a second roller (e.g., idler roller) 48B. The first roller 48A is rotationally mounted on an axle 47A that is fixedly secured to the frame 15. The second roller 48B is rotationally mounted on an axle 47B that is fixedly secured to a moveable portion of a carriage 47. A fixed portion of the carriage 47 is fixedly secured to the frame 15. The carriage 47 is configured to translate the second roller 48B away from the first roller 48A in the direction of the arrow R2, as shown for example, in FIG. 1G-I wherein the accumulator 48 accumulates the web 11 while winding is stopped at the core 38A and the continuous web process line 100 continues to feed the web 11 to the web transfer device 40, during the web transfer process. When the web transfer process is completed, the carriage 47 translates the second roller 48B towards the first roller 48A in the direction of the arrow R1 as shown in FIG. 1J to empty the accumulated web 11 from the accumulator 48.

Figure 1I:
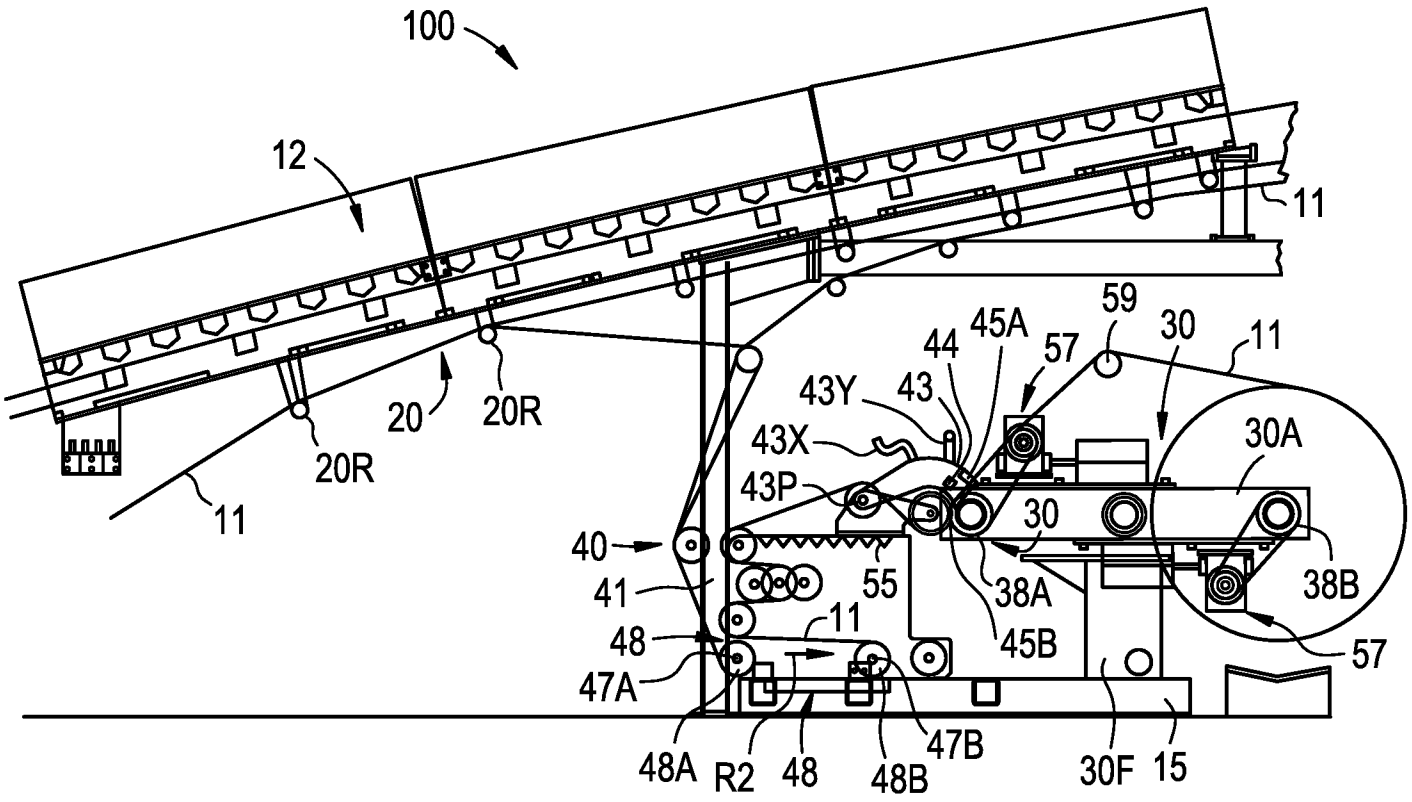
FIG. 1I is a schematic view of the portion of the continuous web processor line showing the severed web clamped against a portion of a vacuum hood of with the transfer device slightly retracted and with the turret indexed to engage and attach a leading edge of the severed web to the new core.
Figure 1J:
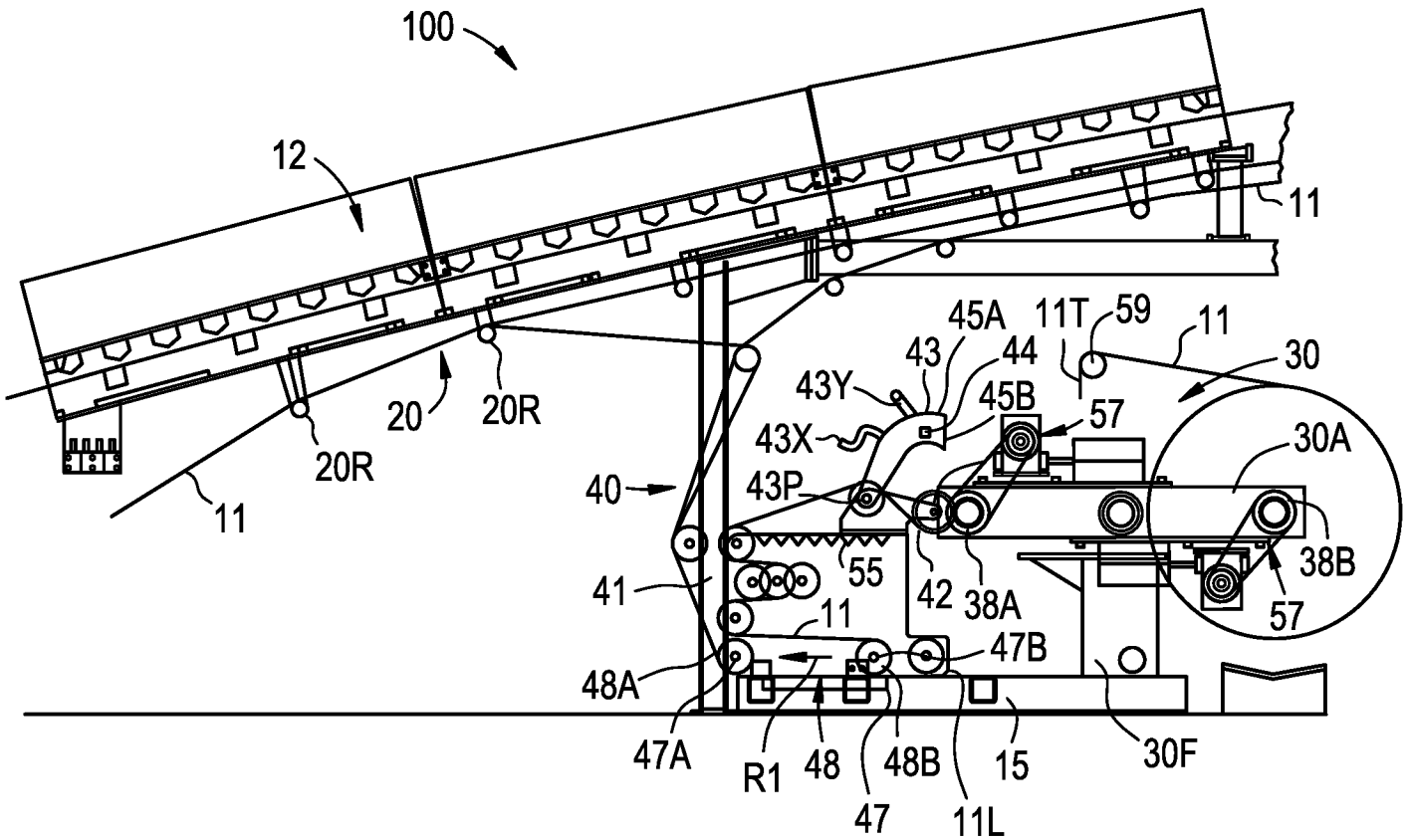
FIG. 1J is a schematic view of the portion of the continuous web processor line showing a trailing edge of the severed web being rolled onto the full core and with the vacuum hood retracted.

In one embodiment according to the sequence in the order of FIGS. 1A to 1J, a method for web transfer includes an initial thread-up with the carriage 55 retracted. A rope threading rig is supplied to facilitate web thread-up through a dancer 56 and the accumulator 48 (see FIG. 1A). With the web 11 attached to core 38A the carriage 55 comes forward in the direction of the arrow R3 to run the lay-on roll 42 in contact surface mode or gap winding mode with the core 38A. (See FIG. 1B). The lay-on roll 42 moves in the direction indicated by the arrow R4 in the contact or gap mode until turret 30 is ready (i.e., the core 38A is full) to index for roll-change. (See FIG. 1C). The lay-on roll 42 and carriage 55 further retract in the direction of the arrow R4 away from the full core 38A to allow the full core 38A to index on the turret arm 30A. (See FIG. 1D). The turret 30 indexes a new core 38B into a roll-change position. (See FIG. 1E). The lay-on roll 42 and the carriage 55 move towards the new core 38B in the direction of the arrow R5 into the web transfer position. (See FIG. 1F). The vacuum hood 43 lowers (e.g., pivots about the pivot point 43P) with a vacuum source 43X and/or 43Y applied. (See FIG. 1G). The full core 38A goes to zero speed. (See FIG. 1G). The accumulator 48 starts to fill as indicated by the arrow R2. (See FIG. 1G). The web 11 is vacuum clamped against vacuum hood 43. (See FIG. 1G). The cutter (e.g., an integral zip knife) translates across the vacuum hood 43 cutting a straight cut leading edge 11L and trailing edge 11T (See FIGS. 1G, 5, 10 and 14). The carriage 55 retracts slightly (e.g., see gap G12 in FIG. 1H) to paste or attach the web 11 onto the new core 38A. The web 11 remains vacuum clamped to the vacuum hood, for example to the suction holding surfaces 45A, 45B. (See FIGS. 1H and 5). The turret 30 indexes the new core 38A into suction holding surfaces 45A, 45B (e.g., rubber faced surfaces with holes therein) vacuum hood 43 applying leading edge of cut web to core. (FIGS. 1I and 5). The vacuum hood 43 releases the trailing edge of the web 11 and retracts to a stand by position. (See FIG. 1J). The full core 38A is rotated via the drive mechanism 57 which winds the trailing edge 11T. (See FIG. 1J). The new core 38A is caused to over speed by the drive mechanism 57 to empty the accumulator 48 by translating the second roller 48B of the accumulator to translate via movement of a portion of the carriage assembly 55 in the direction indicated by the arrow R1. (See FIG. 1J). As shown in FIGS. 1A to 1D, 1I and 1J the turret arm 30A is horizontal.

As shown in FIGS. 1E to 1H the turret arm 30A is in a standby position at an angle γ from horizontal.

Figure 2B:
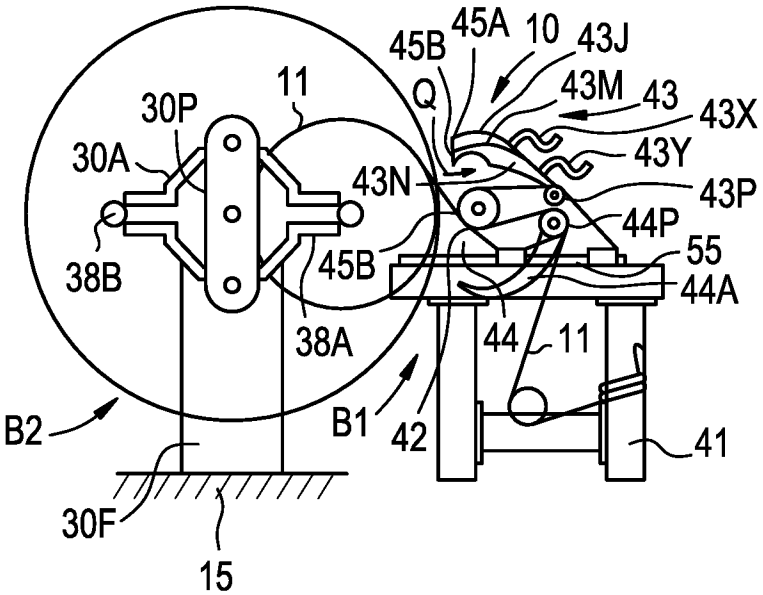
FIG. 2B is a schematic view of the portion of the continuous web processor line of FIG. 2A wherein the vacuum hood and lay-on roll are in a retracted position.
Figure 2A:
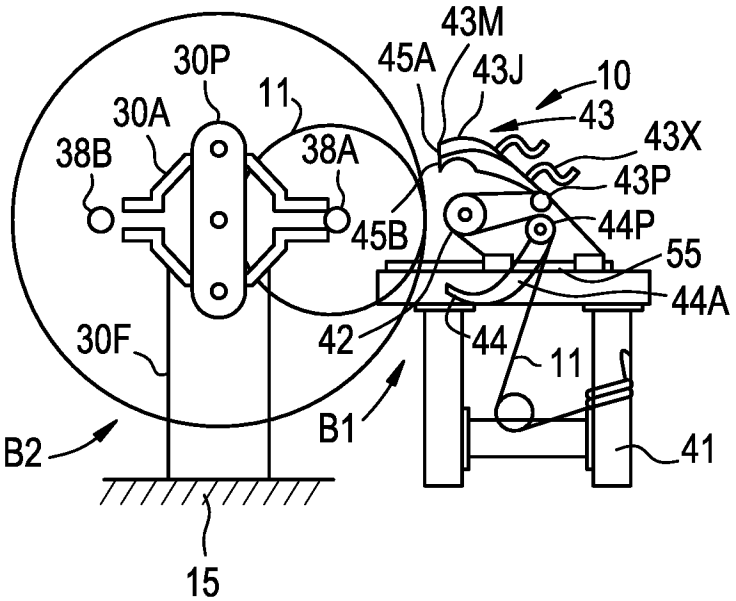
FIG. 2A is a schematic view of a portion of a continuous web processor line showing another embodiment of a vacuum hood and cutter portion of a web transfer device of the present invention in a configuration wherein the winding has stopped.
Figure 2D:
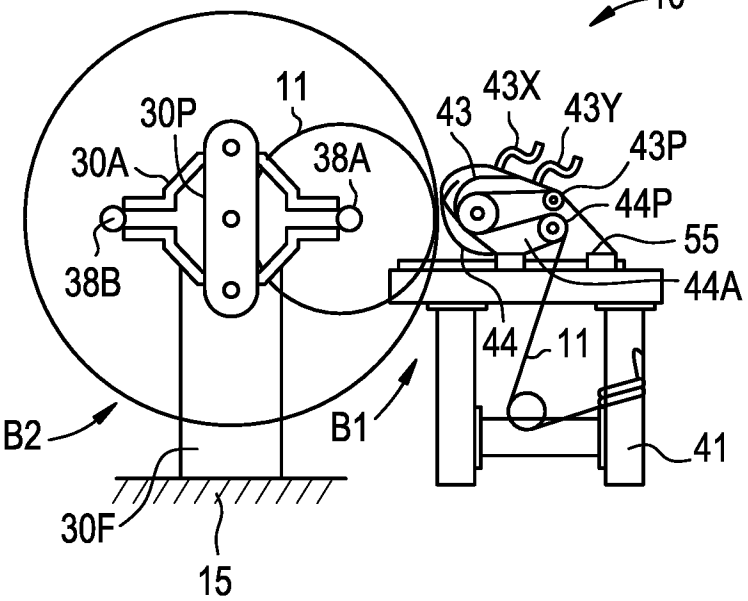
FIG. 2D is a schematic view of the portion of the continuous web processor line of FIG. 2A wherein the cutting arm is raised and cuts the web.
Figure 2C:
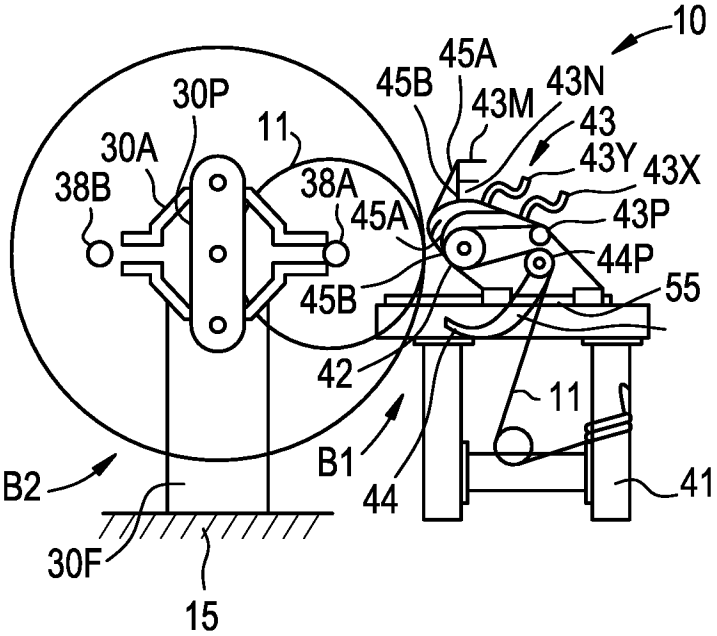
FIG. 2C is a schematic view of the portion of the continuous web processor line of FIG. 2A wherein the vacuum hood grasps the web.
Figure 2F:
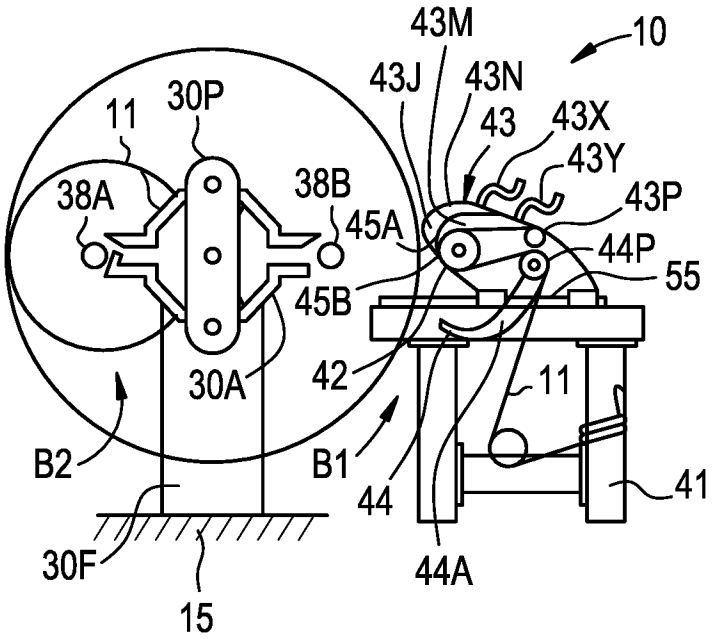
FIG. 2F is a schematic view of the portion of the continuous web processor line of FIG. 2A wherein the turret indexes a new core into the inboard position.
Figure 2E:
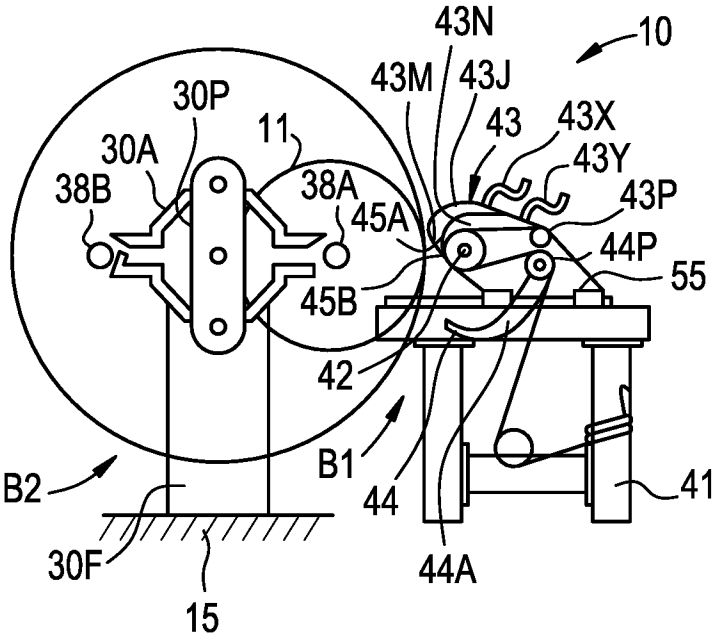
FIG. 2E is a schematic view of the portion of the continuous web processor line of FIG. 2A wherein the cutting arm retracts and vacuum is released from the upper chamber and maintained in the lower chamber.
Figure 2H:
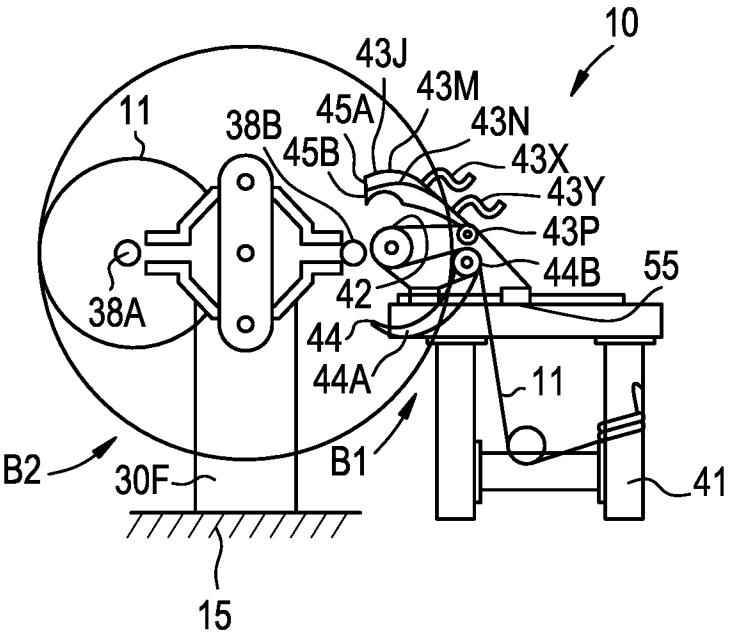
FIG. 2H is a schematic view of the portion of the continuous web processor line of FIG. 2A.
Figure 2G:
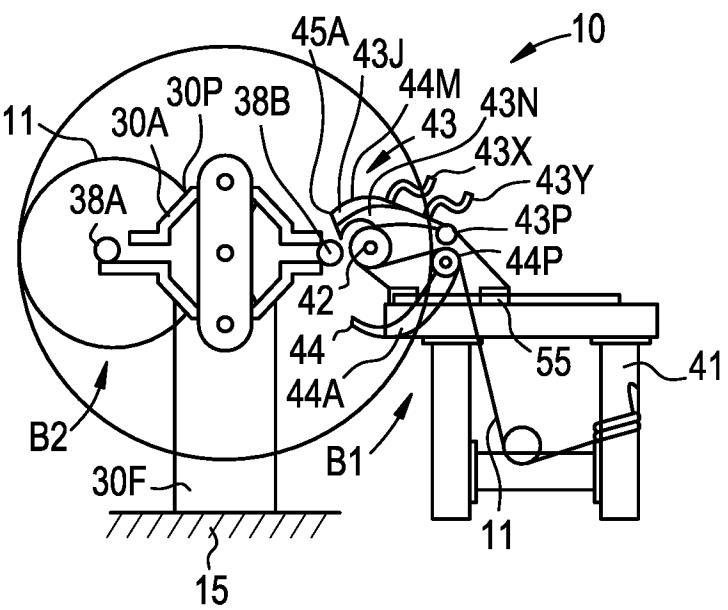
FIG. 2G is a schematic view of the portion of the continuous web processor line of FIG. 2A wherein the vacuum hood and lay-on roll is extended to attach the leading edge of the web to the new core.

In one embodiment according to the sequence in the order of FIGS. 2A to 2H, a method for web transfer includes winding the web 11 on the core 38A until it is full (e.g., core 38A is wound to a 40-inch diameter). (See FIG. 2A). The vacuum hood 43 is applied to the web 11 when the core 38A is stopped and the accumulator 48 starts to fill. (See FIG. 2A). In the embodiment shown in FIGS. 2A-2H the vacuum hood 43 is a clamp configuration having an upper jaw 43J that houses the vacuum chambers 43M and 43N which are in communication with the vacuum sources 43X and 43Y which can be controlled (e.g., activated and deactivated) individually, independent of one another or together. The upper jaw 43J is pivotable about the pivot point 43P. The vacuum hood 43 of the clamp configuration shown in FIGS. 2A to 2H includes a cutting arm 44A that is pivotable about pivot point 44P. The cutting arm 44A includes the cutter 44 therein. As shown in FIG. 2B, the lay-on roll 42 and carriage assembly 55 retract exposing the web 11 to be grasped and cut. The upper jaw 43J of the vacuum hood 43 is moved (e.g., pivoted or lowered) to engage the web 11 and vacuum is applied in both vacuum chambers 43M and 43N thereby grasping the web against the suction holding surfaces 45A, 45B (e.g., perforated rubber web holding plate). (See FIG. 2C). The cutting arm 44A moves (e.g., pivots or is raised) to engage the cutter 44 with the web 11 and then cut the web 11. (See FIGS. 2C and 2D). The cutting arm 44A retracts and vacuum is turned off to chamber 43M thereby releasing the trailing edge 11T of the web 11 from the suction holding surfaces 45A and the trailing edge 11T is wound onto the full core 38A. (See FIG. 2E). The new leading edge 11L of the web 11 is retained against suction holding surface 45B. (See FIG. 2E). The turret 30 indexes the new core 38B into the web attachment position as shown in FIG. 2F. As shown in FIG. 2G, the lay-on roll 42 and the carriage assembly 55 extend inwardly toward the new core 38B and the holding surface 45B attaches the leading edge 11L of the web 11 to the new core 38B by releasing the vacuum from the second vacuum chamber 43N. As shown in FIG. 2H, the carriage assembly 55 extends inwardly to cause the lay-on roll 42 to engage or be in gap proximity to the new core 38B while the upper jaw 43J of the vacuum hood 43 retracts.

Figure 4:
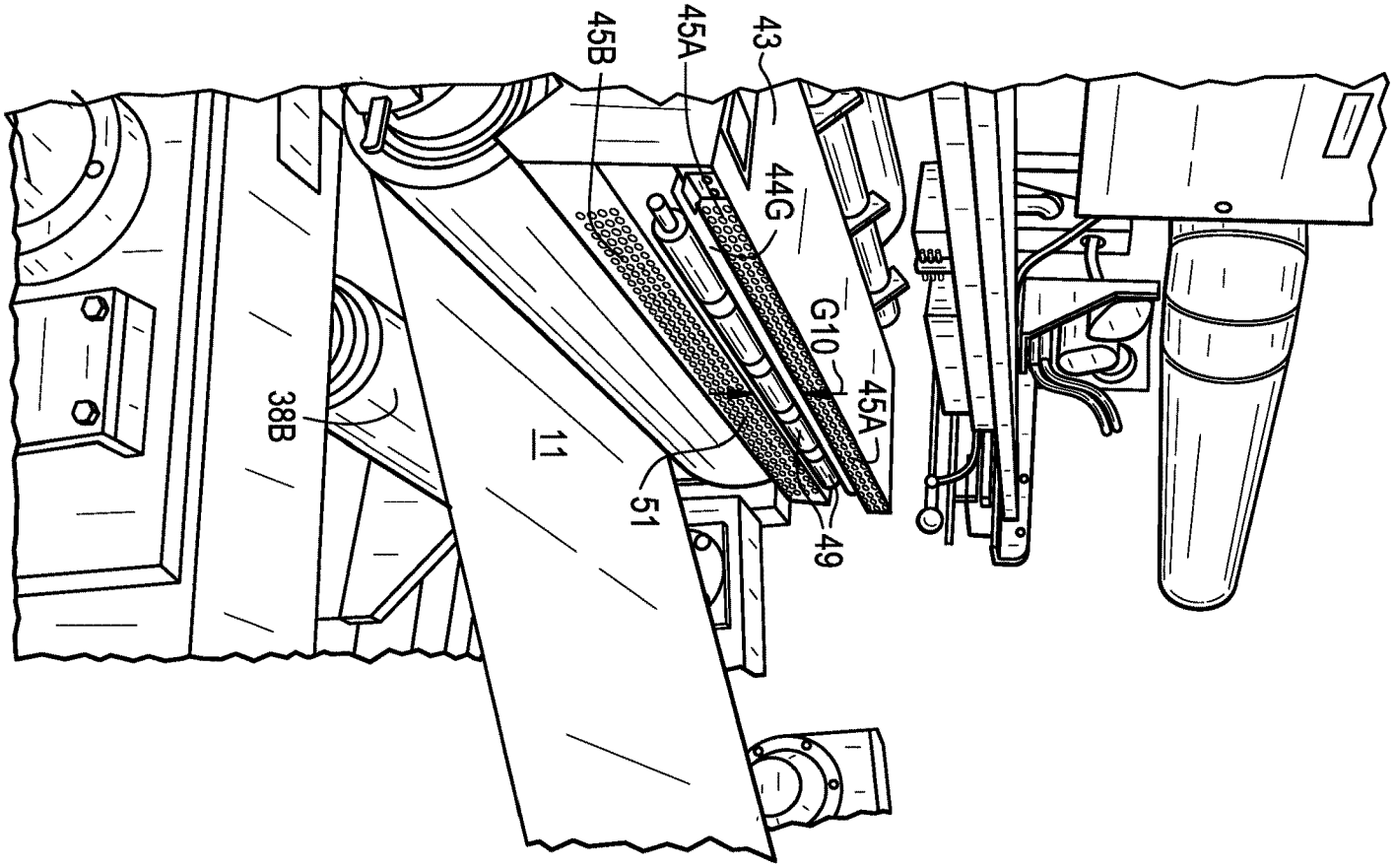
FIG. 4 is a photograph of a portion of a web transfer device of the present invention in a continuous web processing line showing the vacuum hood retracted.
Figure 6:
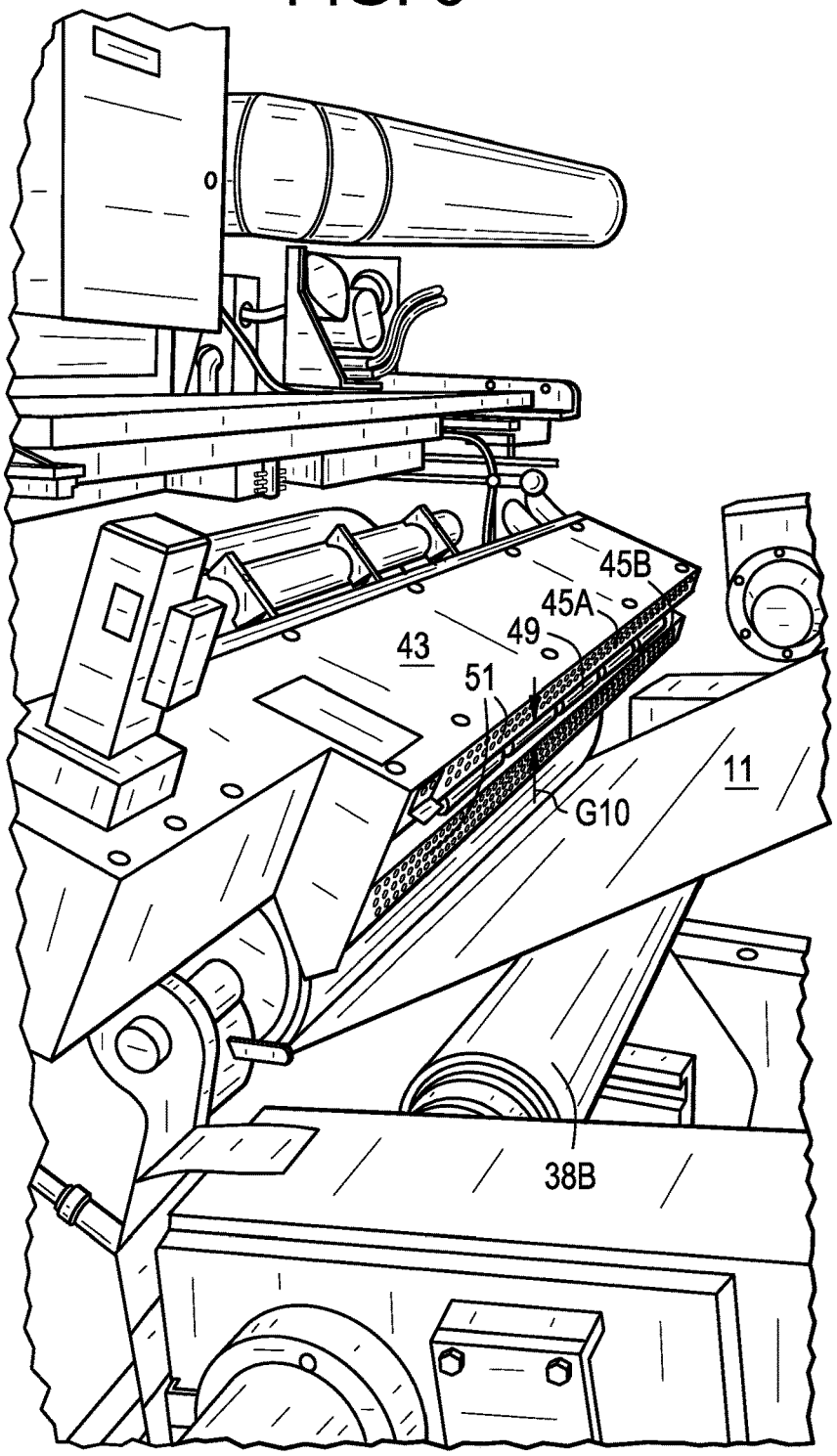
FIG. 6 is a photograph of the web transfer device of the continuous web processing line of FIG. 5 showing the vacuum hood beginning to pivot towards the new core.
Figure 7:
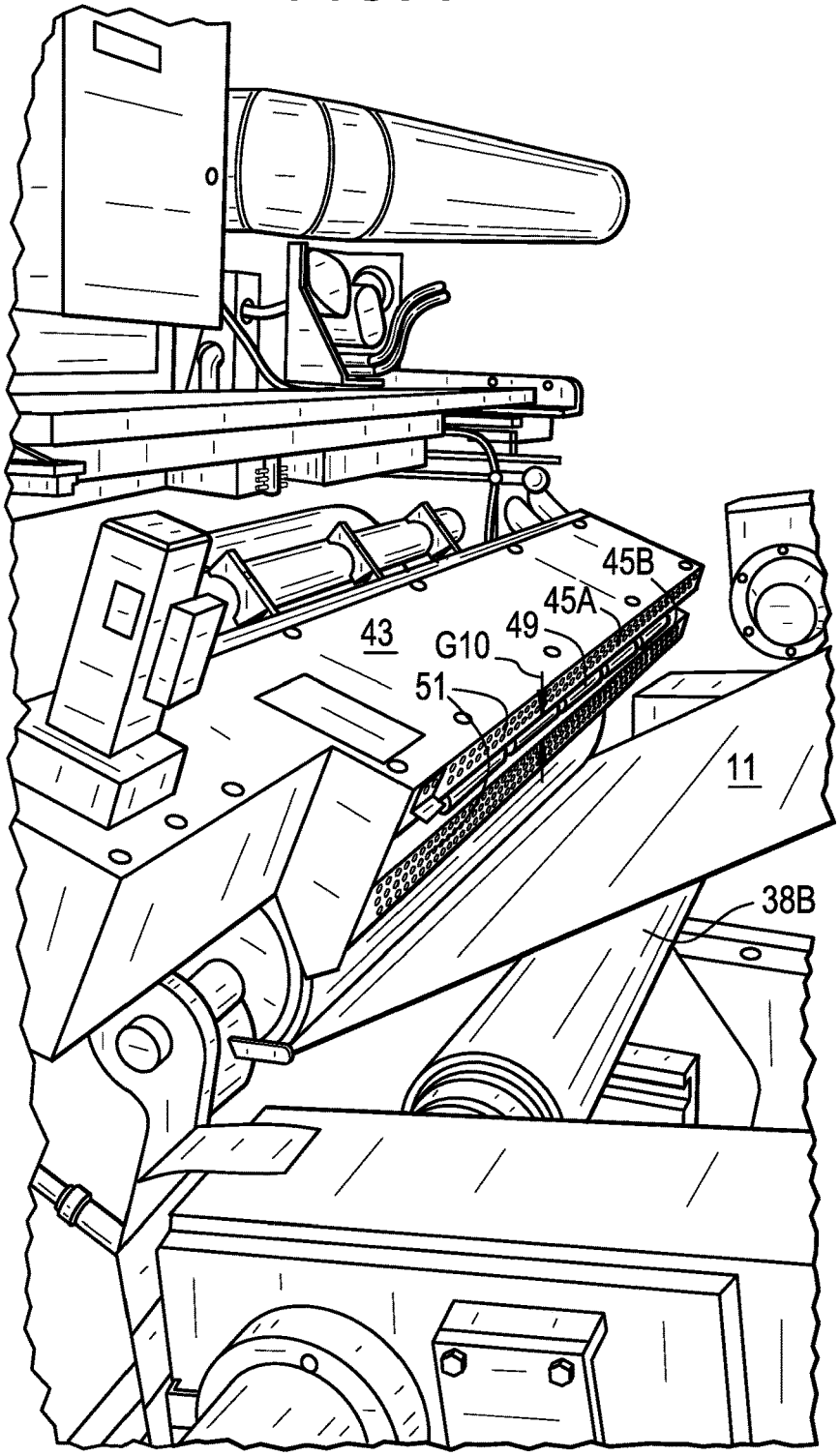
FIG. 7 is a photograph of the web transfer device of the continuous web processing line of FIG. 5 showing the vacuum hood further pivoting towards the new core.
Figure 8:
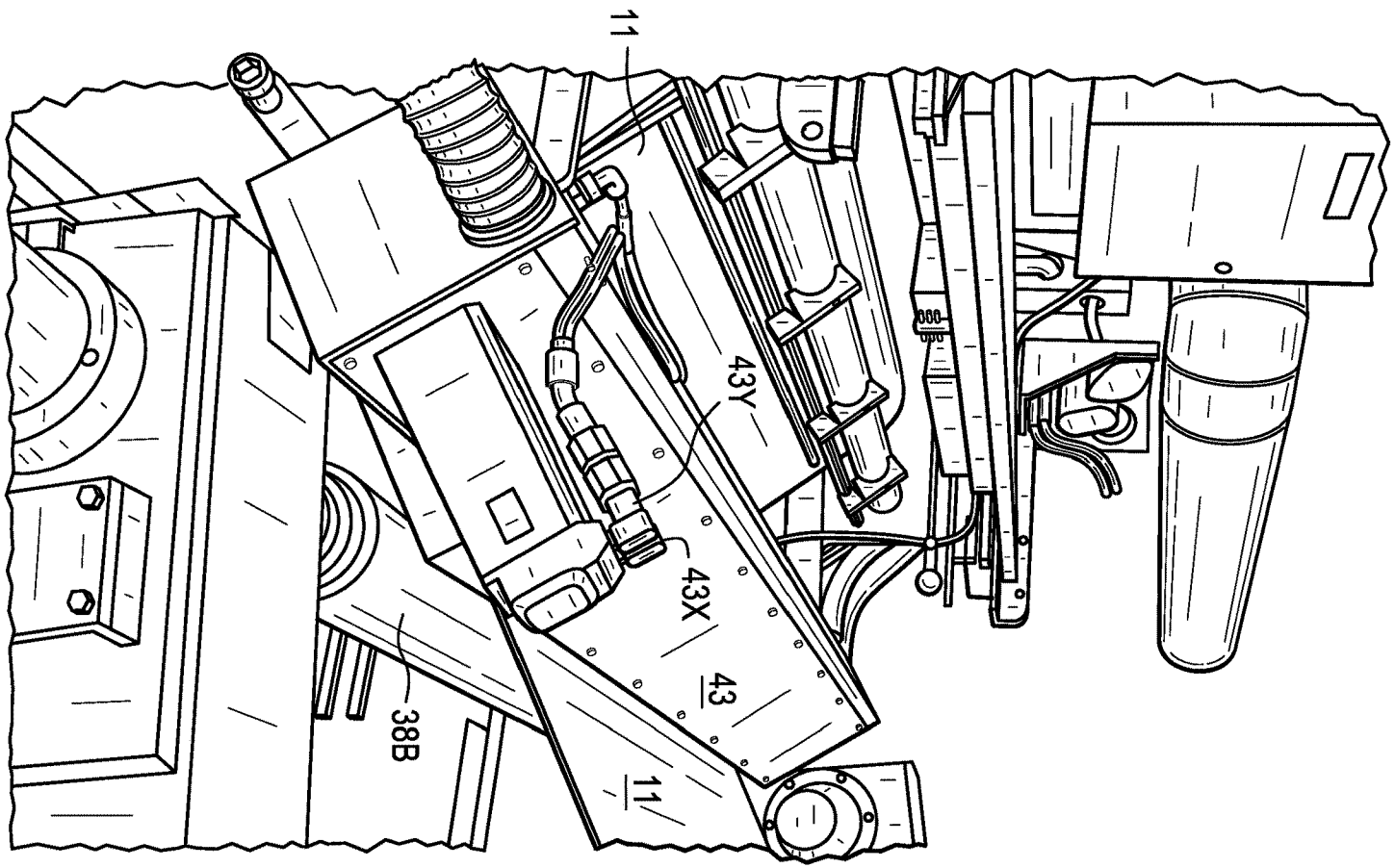
FIG. 8 is a photograph of the web transfer device of the continuous web processing line of FIG. 5 showing the vacuum hood grasping and cutting the web.
Figure 9:
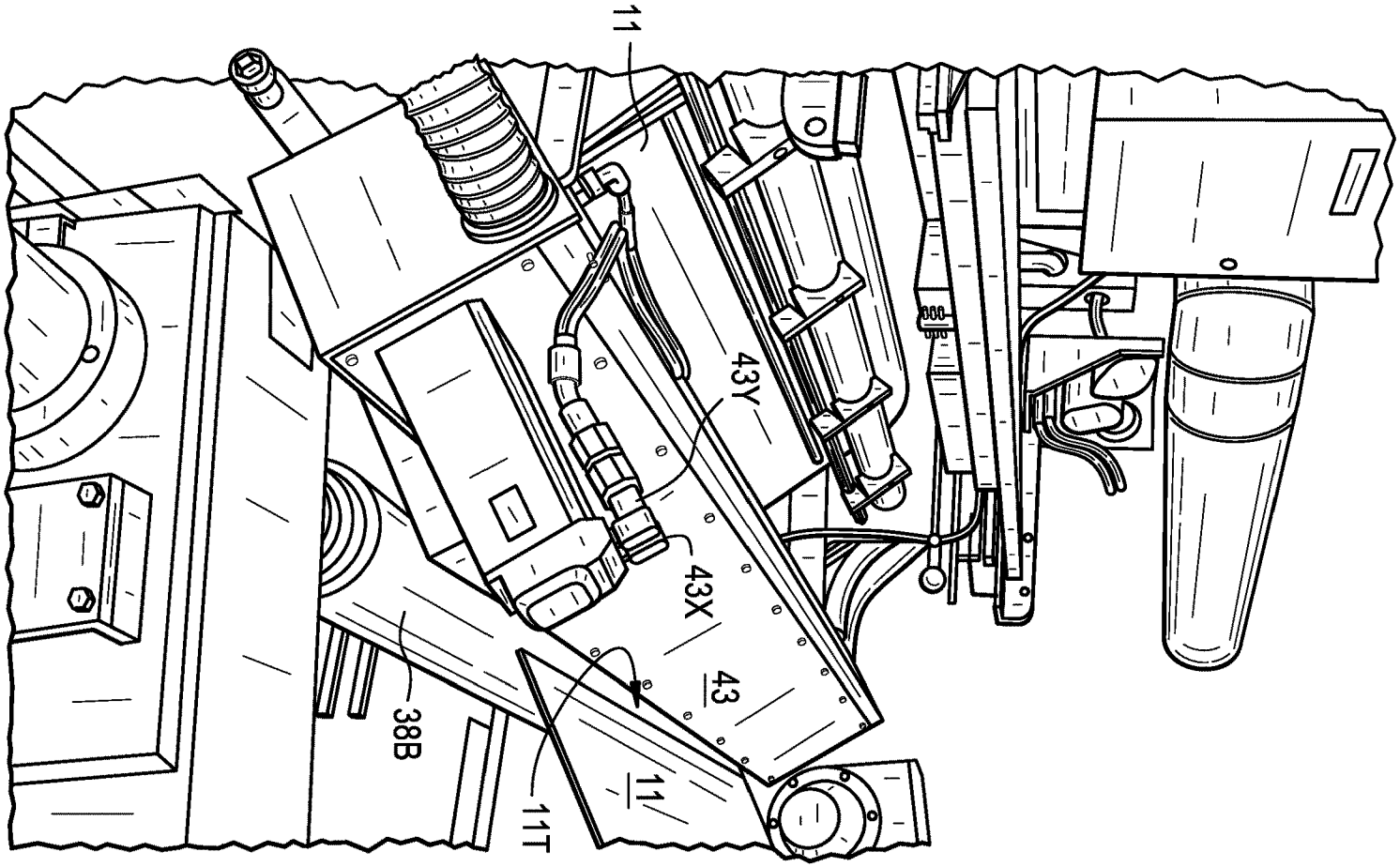
FIG. 9 is a photograph of the web transfer device of the continuous web processing line of FIG. 5 showing the trailing edge of the web being released from the vacuum head.
Figure 10:
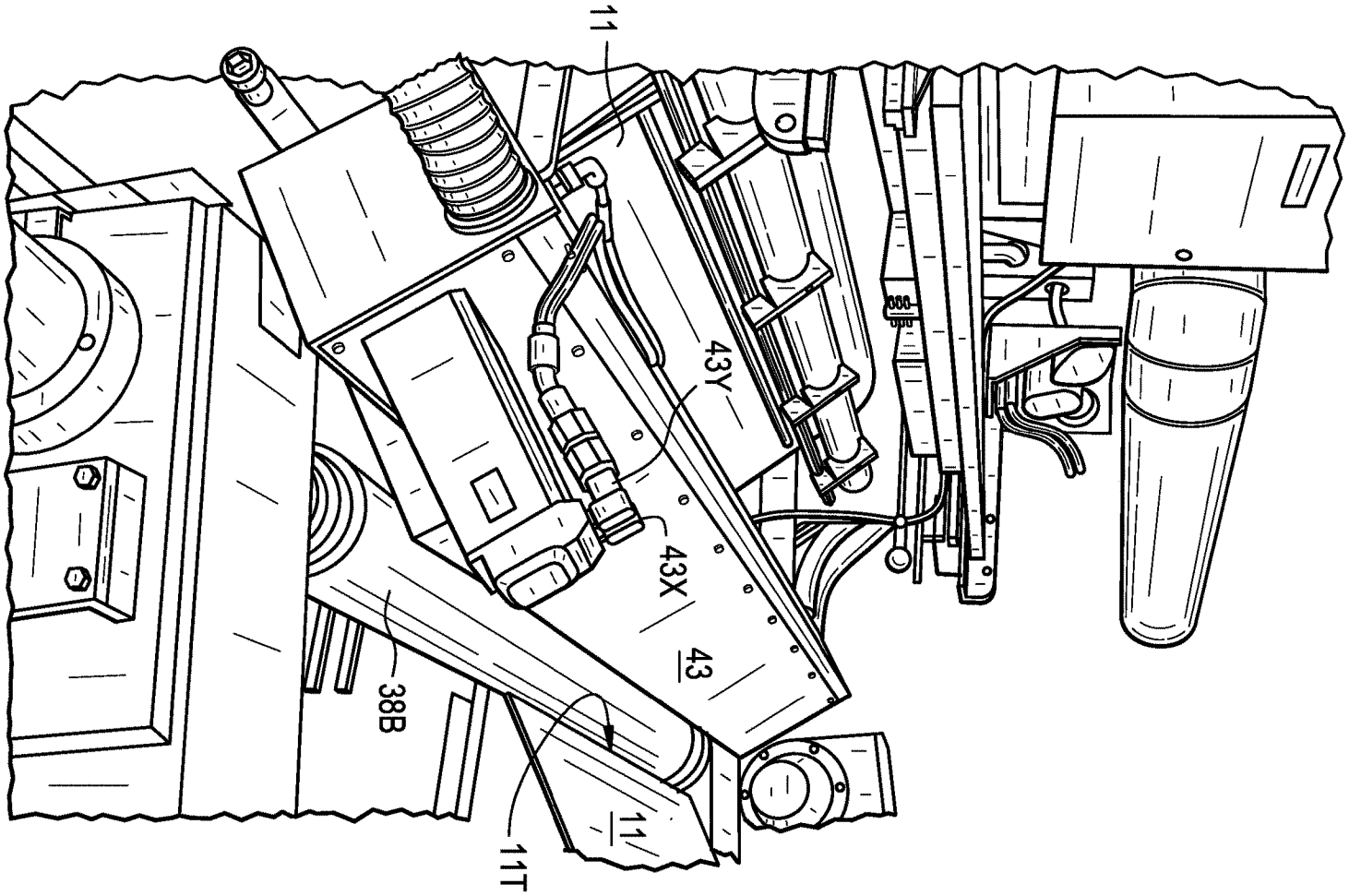
FIG. 10 is a photograph of the web transfer device of the continuous web processing line of FIG. 5 showing the trailing edge of the web released from the vacuum head and the vacuum hood pivoting further towards the new core.
Figure 11:
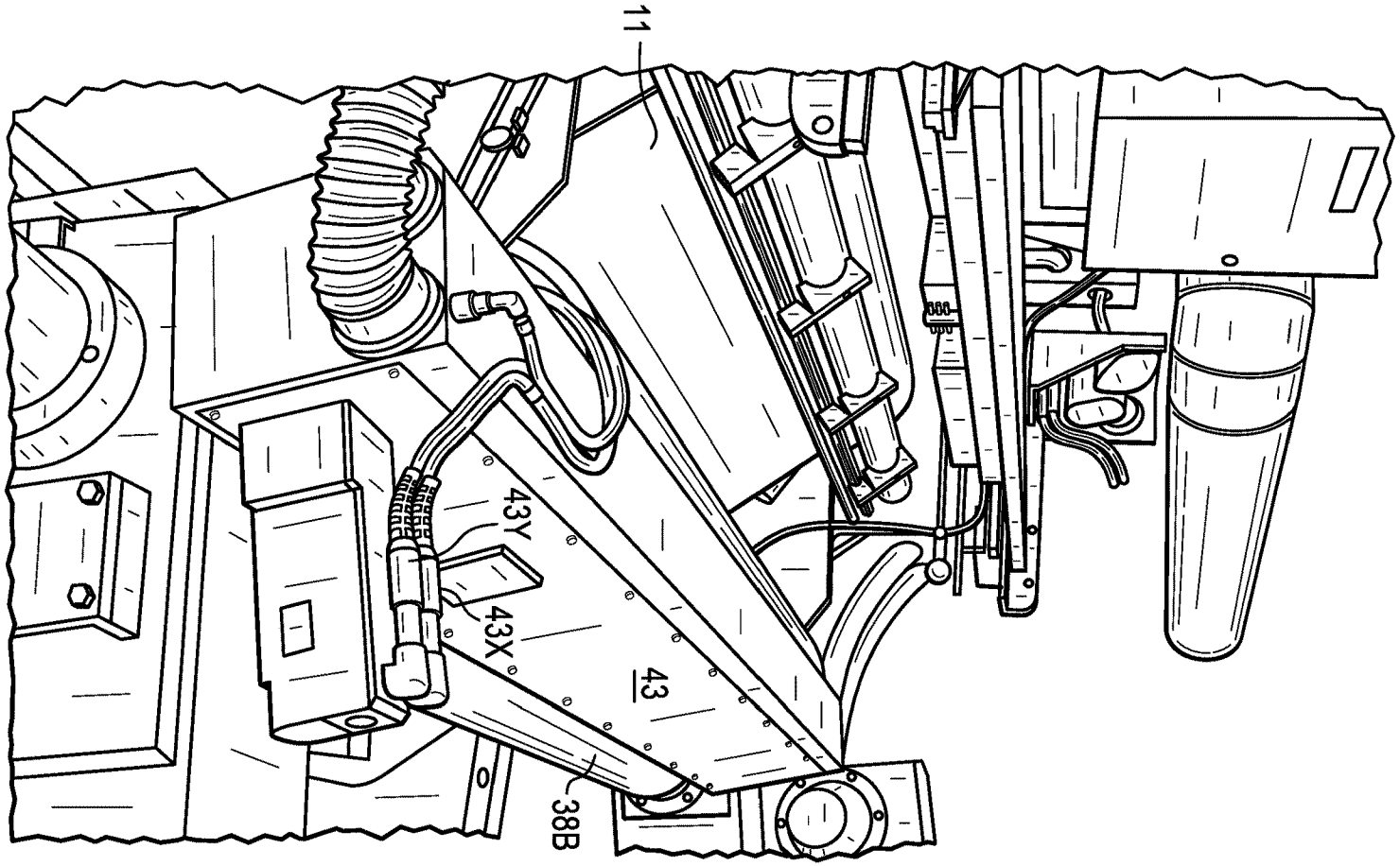
FIG. 11 is a photograph of the web transfer device of the continuous web processing line of FIG. 5 showing the vacuum hood pivoting further towards the new core.
Figure 12:
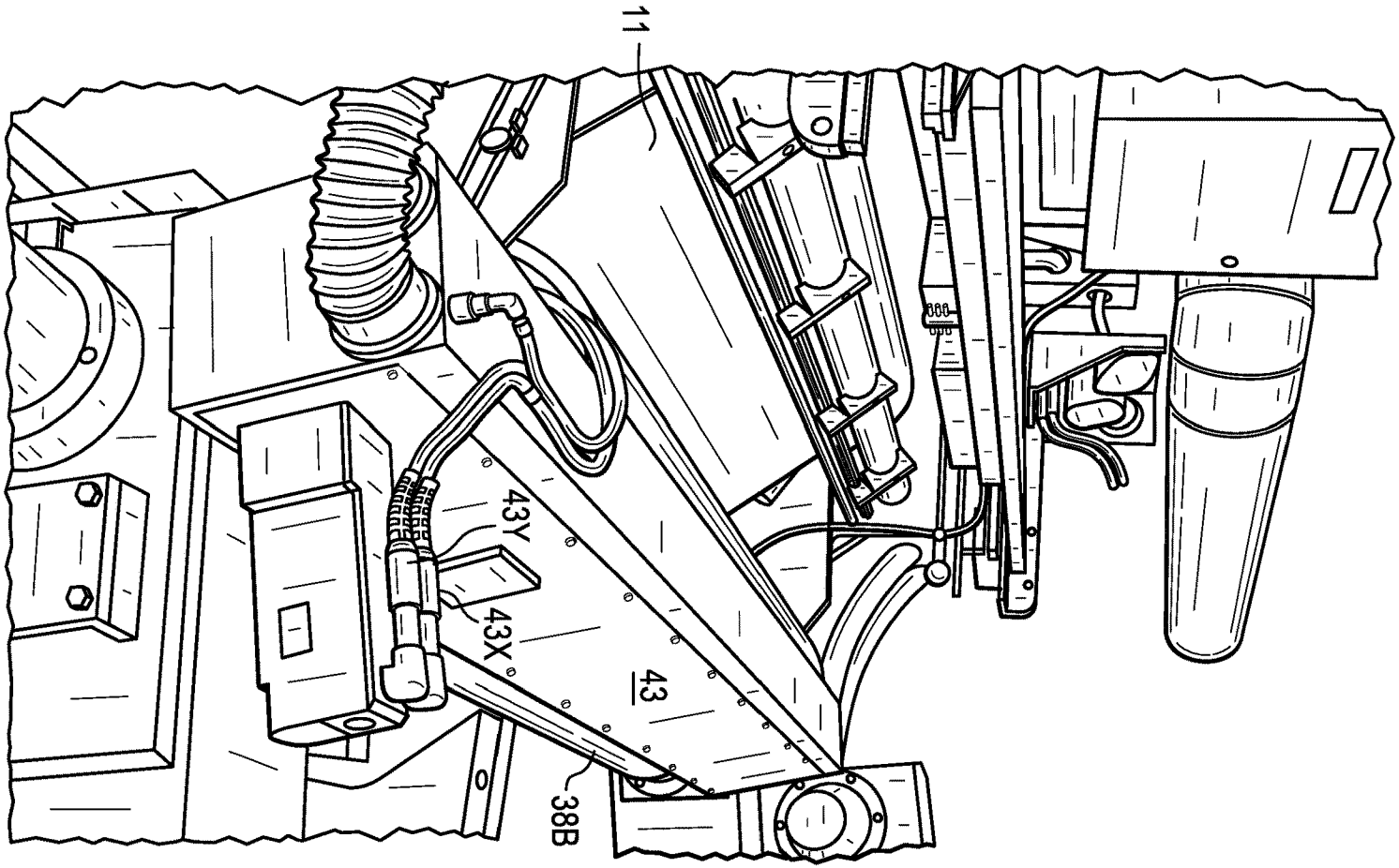
FIG. 12 is a photograph of the web transfer device of the continuous web processing line of FIG. 5 showing the vacuum hood securing the leading edge of the web to the new core.
Figure 13:
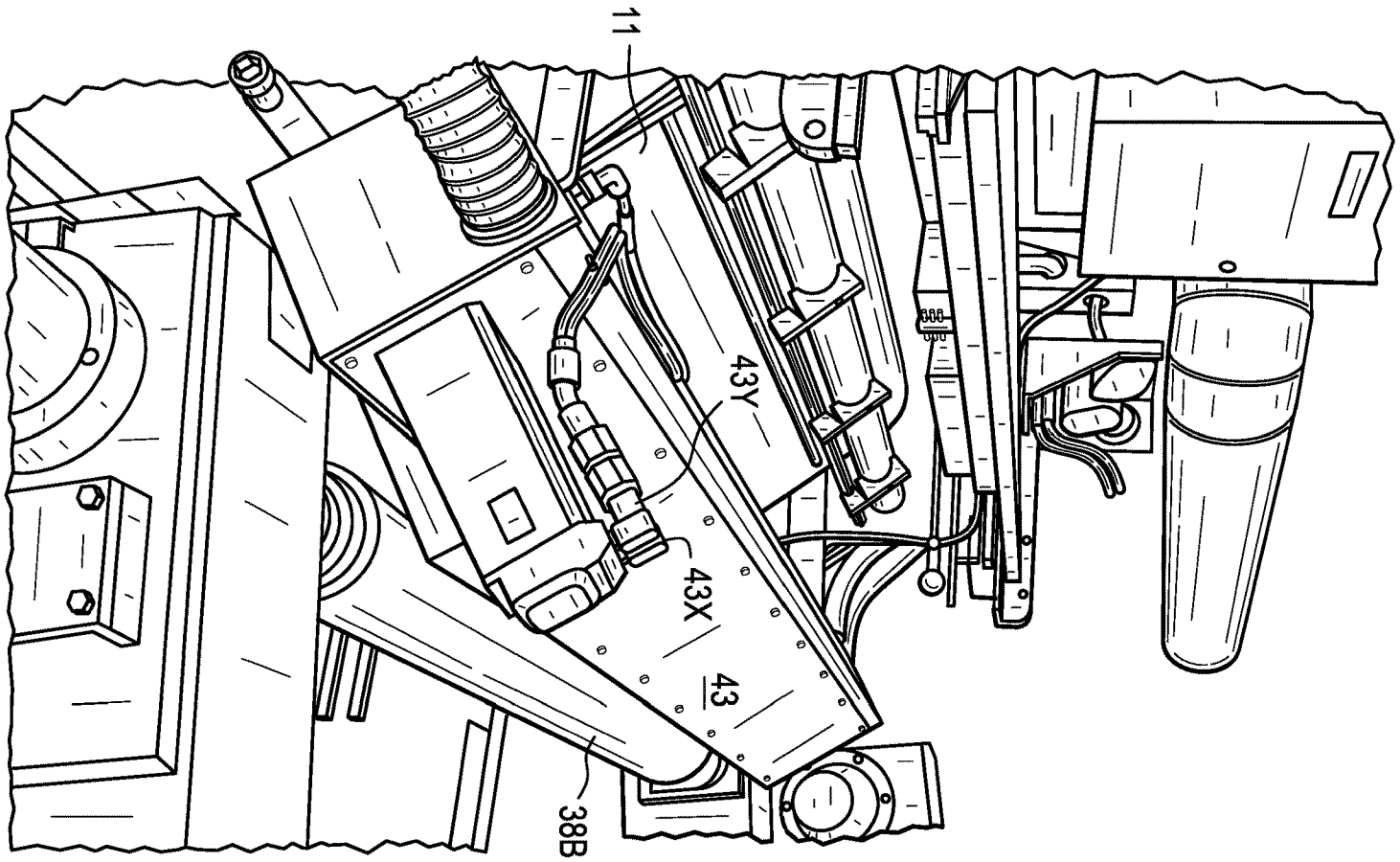
FIG. 13 is a photograph of the web transfer device of the continuous web processing line of FIG. 5 showing the vacuum hood pivoting away from the new core.
Figure 14:
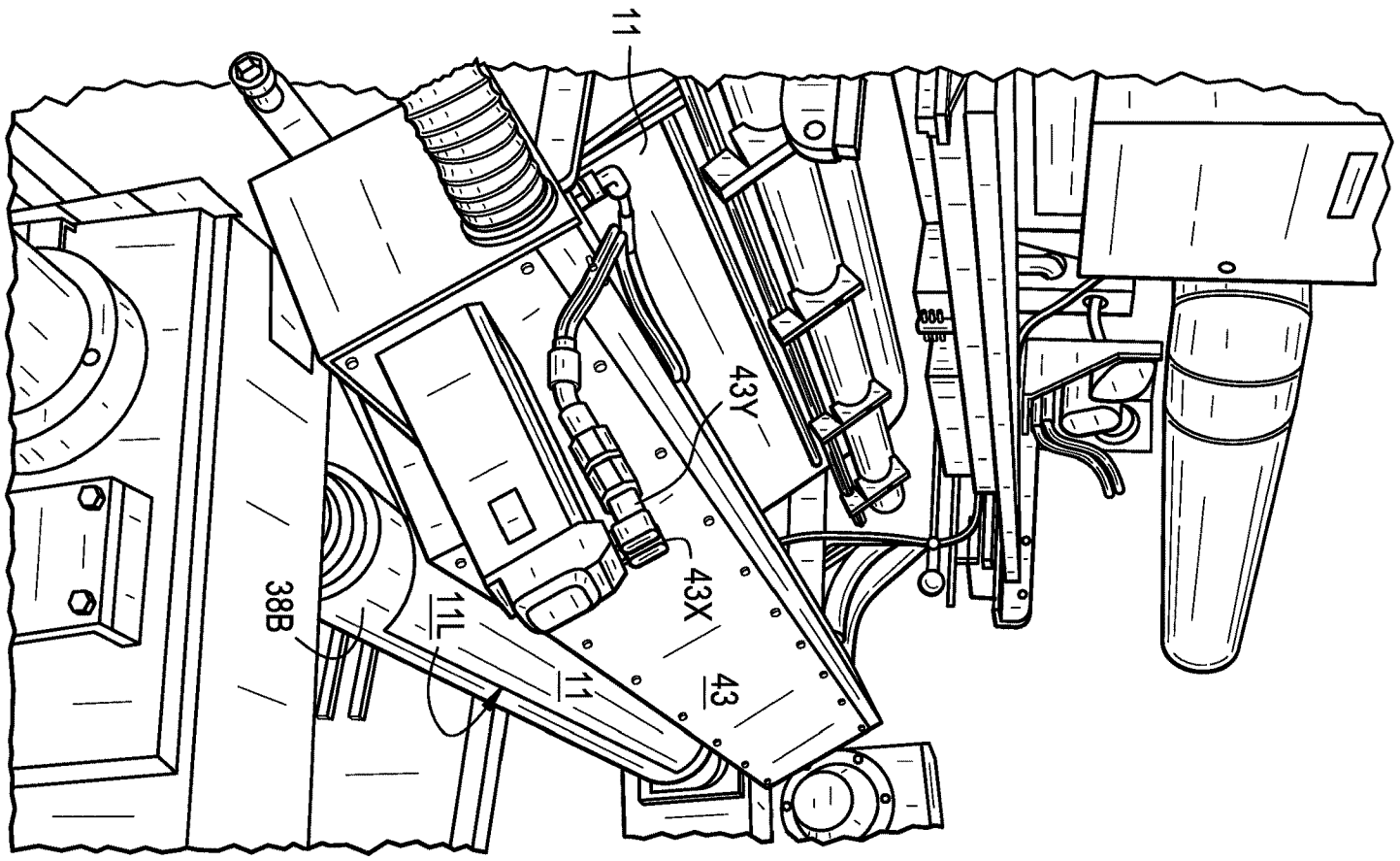
FIG. 14 is a photograph of the web transfer device of the continuous web processing line of FIG. 5 showing the vacuum hood pivoting away from the new core and with the new core rotating with the leading edge of the web attached thereto.
Figure 15:
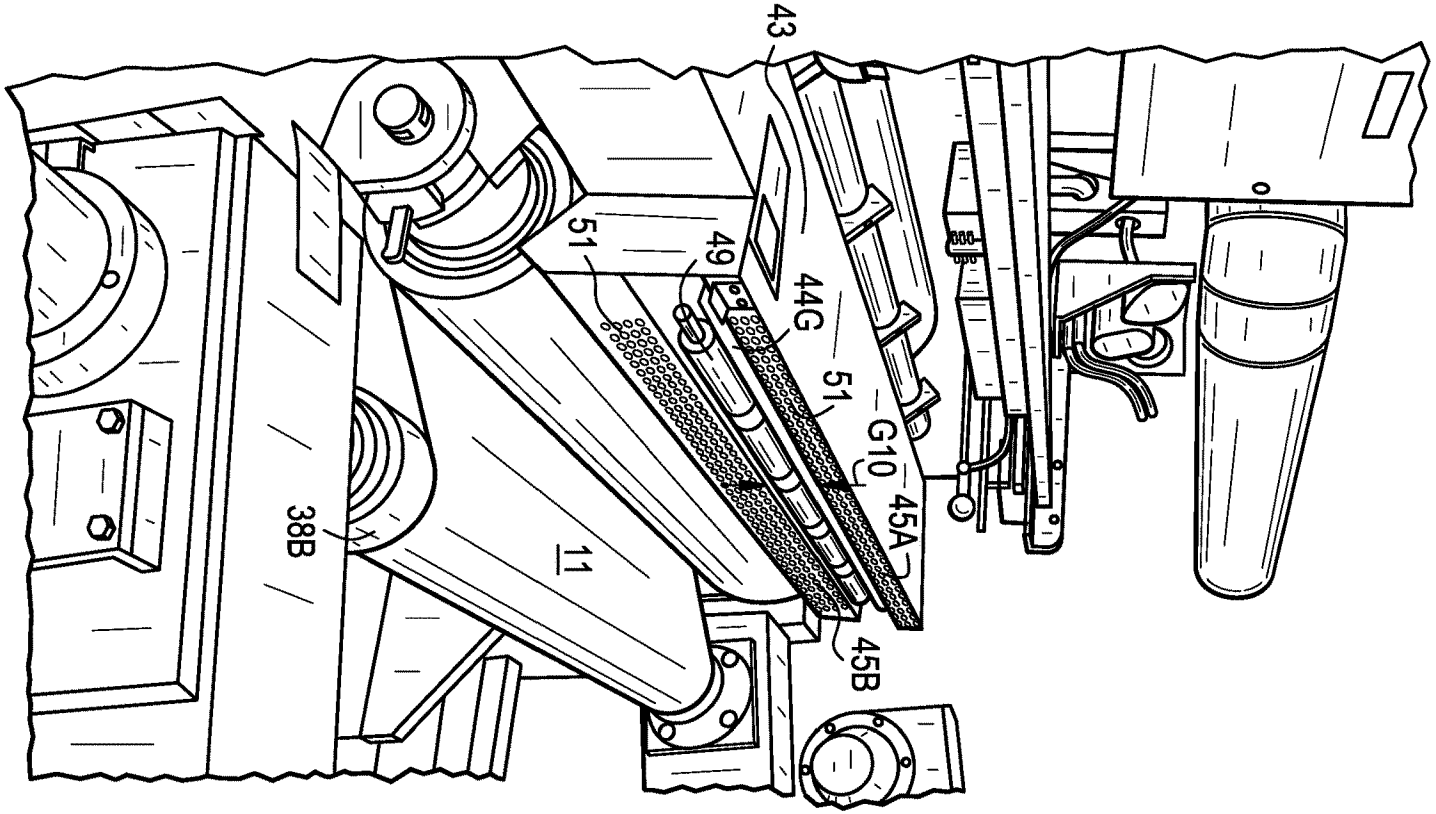
FIG. 15 is a photograph of the web transfer device of the continuous web processing line of FIG. 5 showing the vacuum hood in the standby position pivoted away from the new core and with the new core rotating with the leading edge of the web wound there around.

In one embodiment according to the sequence in the order of FIGS. 4 to 15, a method for web transfer includes a standby configuration wherein the vacuum hood 43 is retracted as shown in FIGS. 4 and 5. As shown in FIG. 6 the vacuum hood 43 begins to pivot towards the new core 38B. As shown in FIG. 7 the vacuum hood further pivots towards the new core 38B. As shown in FIG. 8 is the vacuum hood grasps the web 11 and cuts the web 11. As shown in FIG. 9 the trailing edge 11T of the web 11 is released from the suction holding surface 45A of the vacuum head 43. As shown in FIGS. 10 and 11, after release of the trailing edge 11T, the vacuum hood 43 pivots further towards the new core 38B. As shown in FIG. 12 the leading edge 11L of the web 11 is secured to the new core 38B. As shown in FIG. 13 the vacuum hood 43 pivots away from the new core 38B. As shown in FIG. 14 the new core 38B is rotating with the leading edge 11L of the web 11 attached thereto. As shown in FIG. 15, the vacuum hood 43 in the standby position pivoted away from the new core 38B and with the new core 38B rotating with the leading edge 11L of the web 11 wound there around.

Figure 3:
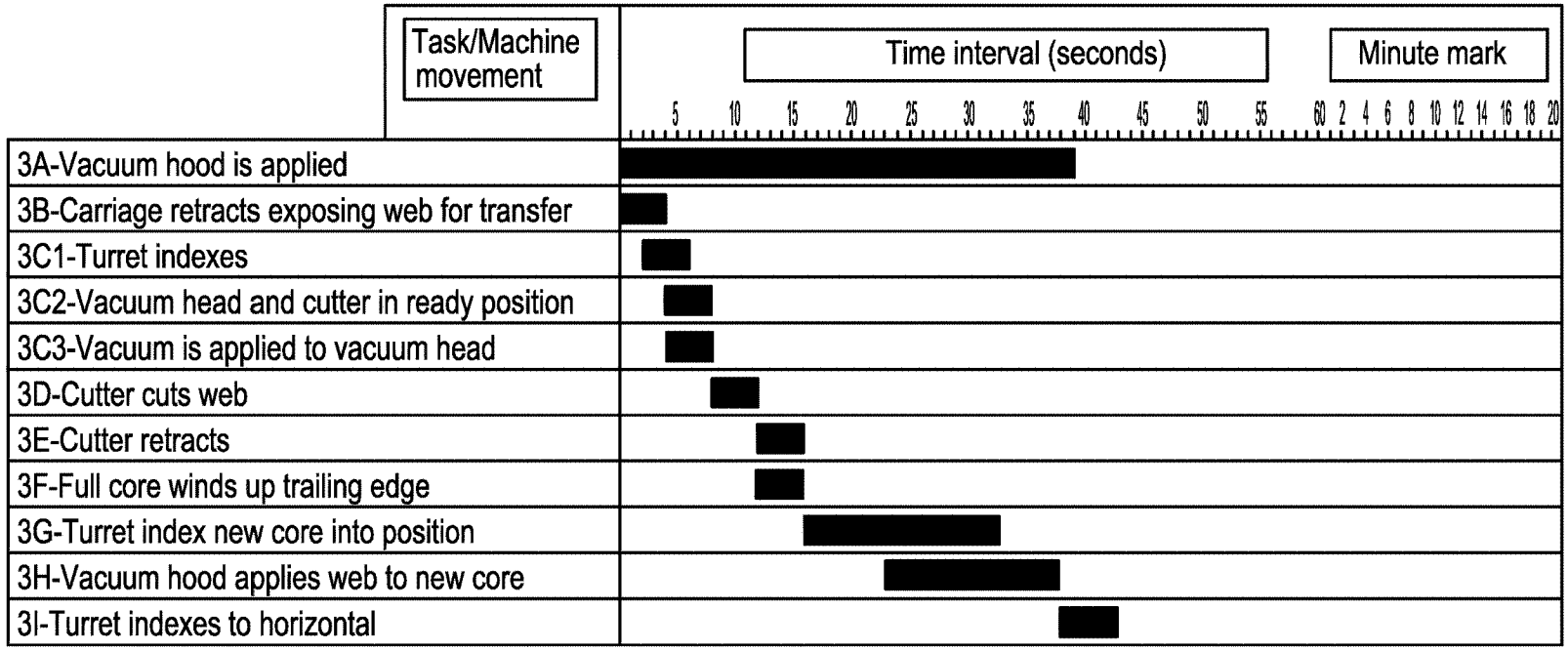
FIG. 3 is a graphical representation of one embodiment of the movement sequence of a web transfer device of the present invention.

In one embodiment, according to the sequence in FIG. 3, a method for web transfer includes applying the vacuum hood 43 to the web 11 while the web is stopped at the core 38A but the line 100 continues to produce the web 11 and during which the web 11 is accumulated in the accumulator 48 (step 3A). The carriage assembly 55 retracts, exposing the web 11 for transfer (step 3B). The turret 30 indexes to proper position based upon the diameter of the core 38A (step 3C1). The cutter 44 and vacuum hood 43 actuate into position proximate the web 11 (step 3C2). The vacuum is applied to vacuum hood 43 (step 3C3). The cutter 44 cuts the web 11 (step 3D). The cutter 44 retracts (step 3E). The full core 38A winds up the trailing edge 11T (step 3F). The turret 30 index a new core 38B into the inboard position B1 (step 3G). The vacuum hood 43 applies the leading edge 11L of the web 11 to new core 38B (step 38H). The turret 30 indexes to a horizontal position (step 3I).

In one embodiment, during the transfer operation, the web 11 is stopped at a position just prior to the core 38A while the process line 100 continues to run while the web 11 is stored in the accumulator 48 as shown in FIG. 1A. While the web 11 is stopped at the core 38A and prior to the indexing of the turret 30, the vacuum hood 43 is positioned over the finished roll 38A of web material while in the inboard position. A cutter 44 (e.g., chopper type or traversing razor type knife) severs the web 11 at the outer most wrap of the finished roll without disturbing the outer most wrap of the finishing wound roll of web material. The vacuum hood 43 holds the leading edge 11L of web material just prior to, during and after the web 11 is severed. The turret 30 then rotates to position a new core 38B under the vacuum hood in the inboard position B1. The vacuum hood 43 with the leading edge 11L of web 11 adhered to it lowers to the new core 38B. Either by tape or adhesive on the new core 38B, or self-adhesive on the web 11, the web 11 is attached to the new core 38B. The vacuum source 43X and 43Y are turned off, the vacuum hood 43 retracts and winding begins. The accumulator 48 is unloaded by running the new core 38B faster than the process web leading into the accumulator 48. The above described sequence is repeated.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A web transfer device for a multiple turret winder in a continuous web process line, the transfer device comprising:

a web delivery assembly comprising at least one web delivery roll;

a core transfer assembly comprising at least two core receiving structures; and a web transfer assembly configured to receive a web from the web delivery assembly and configured to communicate with the core transfer assembly, the web transfer assembly comprising a frame and lay-on roll moveably positioned relative to the frame, the web transfer assembly comprising a vacuum hood assembly moveably positioned relative to the frame, the vacuum hood assembly comprising:

a pivot assembly for pivotally mounting the vacuum hood assembly to a carriage;

at least one chamber defined within the vacuum hood assembly;

the at least one chamber having a first inlet defined by a first suction holding surface, the first suction holding surface has a first plurality of holes extending therethrough; and the at least one chamber having a second inlet defined by a second suction holding surface, the second suction holding surface has a second plurality of holes extending therethrough;

wherein the vacuum hood assembly has cutting device mounted therein, the first suction holding surface being configured to releasably hold a portion of the web, the second suction holding surface being movable relative to the frame and the at least one core receiving structure, and at least one of the first and second suction holding surfaces communicating with the at least one core receiving structure to transfer the web thereto.

2. The web transfer device of claim 1, wherein the first inlet and the second inlet are spaced apart from one another defining a gap therebetween, and a plurality of rollers is positioned in the gap.

3. The web transfer device of claim 1, wherein the at least one of the first and second suction holding surfaces is coated with a lubricious material.

4. The web transfer device of claim 3, wherein the lubricious material comprises PTFE.

5. A method for transferring a web in a continuous web process line, the method comprising:

providing a web transfer device for a multiple turret winder, the transfer device comprising a web delivery assembly comprising at least one web delivery roll, a core transfer assembly comprising at least two core receiving structures; and a web transfer assembly configured to receive a web from the web delivery assembly and configured to communicate with the core transfer assembly, the web transfer assembly comprising a frame and lay-on roll moveably positioned relative to the frame, the web transfer assembly comprising a vacuum hood assembly moveably positioned relative to the frame, the vacuum hood assembly having cutting device mounted therein;

a pivot assembly for pivotally mounting the vacuum hood assembly to a carriage;

at least one chamber defined within the vacuum hood assembly;

the at least one chamber having a first inlet defined by a first suction holding surface, the first suction holding surface has a first plurality of holes extending therethrough; and the at least one chamber having a second inlet defined by a second suction holding surface, the second suction holding surface has a second plurality of holes extending therethrough;

stopping the web on one of the at least two core receiving structures;

holding the web with at least one of the first or second suction holding surfaces;

cutting the web with the cutting device to create a leading edge and a trailing edge;

releasing the trailing edge from the at least one of the first or second suction holding surfaces;

securing the leading edge, via the at least one of the first or second suction holding surfaces, to another of the least two core receiving structures.

6. The method for transferring a web of claim 5, wherein the cutting of the web is performed before indexing of the at least two core receiving structures with the core transfer assembly.

7. The method for transferring a web of claim 5, wherein the cutting of the web is performed after indexing of the at least two core receiving structures with the core transfer assembly.

8. The method for transferring a web of claim 5, wherein the trailing edge is released from the at least one holding surface before releasing the leading edge.

9. The method for transferring a web of claim 5, wherein the trailing edge is released from the at least one holding surface before indexing of the at least two core receiving structures with the core transfer assembly.

10. The method for transferring a web of claim 5, wherein the trailing edge is released from the at least one of the first or second holding surfaces after indexing of the at least two core receiving structures with the core transfer assembly.

* * * * *